US008620644B2

(12) United States Patent
Ryu et al.

(10) Patent No.: US 8,620,644 B2
(45) Date of Patent: Dec. 31, 2013

(54) ENCODER-ASSISTED FRAME LOSS CONCEALMENT TECHNIQUES FOR AUDIO CODING

(75) Inventors: Sang-Uk Ryu, Goleta, CA (US); Eddie L. T. Choy, Carlsbad, CA (US); Samir Kumar Gupta, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1491 days.

(21) Appl. No.: 11/431,733

(22) Filed: May 10, 2006

(65) Prior Publication Data

US 2007/0094009 A1 Apr. 26, 2007

Related U.S. Application Data

(60) Provisional application No. 60/730,459, filed on Oct. 26, 2005, provisional application No. 60/732,012, filed on Oct. 31, 2005.

(51) Int. Cl.
*G10L 19/00* (2013.01)

(52) U.S. Cl.
USPC ..... 704/201

(58) Field of Classification Search
USPC ..... 704/201, 205, 206
See application file for complete search history.

(56) References Cited

U.S. PATENT DOCUMENTS 5,233,348 A * 8/1993 Pollmann et al. ..... 341/67
5,504,833 A * 4/1996 George et al. ..... 704/211
5,745,169 A * 4/1998 Murphy et al. ..... 348/192
5,761,218 A * 6/1998 Ogura ..... 714/746
5,850,403 A * 12/1998 Lasne ..... 714/755
5,901,234 A * 5/1999 Sonohara et al. ..... 381/104
6,073,151 A * 6/2000 Baker et al. ..... 708/290

(Continued)

FOREIGN PATENT DOCUMENTS

JP 8286698 A 11/1996
JP 10116096 A 5/1998

(Continued)

OTHER PUBLICATIONS

Sang-Uk Ryu et al., "Encoder assisted frame loss concealment for MPEG-AAC decoder," International Conference on Acoustics, Speech, and Signal Processing. Proceedings (ICASSP '06). May 14, 2006-May 19, 2006, Toulouse, France.

(Continued)

*Primary Examiner* — Michael N Opsasnick
(74) *Attorney, Agent, or Firm* — Espartaco Diaz Hidalgo

(57) ABSTRACT

Encoder-assisted frame loss concealment (FLC) techniques for decoding audio signals are described. A decoder may discard an erroneous frame of an audio signal and may implement the encoder-assisted FLC techniques in order to accurately conceal the discarded frame based on neighboring frames and side-information transmitted from the encoder. The encoder-assisted FLC techniques include estimating magnitudes of frequency-domain data for the frame based on frequency-domain data of neighboring frames, and estimating signs of the frequency-domain data based on a subset of signs transmitted from the encoder as side-information. Frequency-domain data for a frame of an audio signal includes tonal components and noise components. Signs estimated from a random signal may be substantially accurate for the noise components of the frequency-domain data. However, to achieve highly accurate sign estimation for the tonal components, the encoder transmits signs for the tonal components of the frequency-domain data as side-information.

49 Claims, 11 Drawing Sheets

(56) References Cited

U.S. PATENT DOCUMENTS

| | | | | |
|---|---|---|---|---|
| 6,240,141 | B1 * | 5/2001 | Long | 375/260 |
| 6,751,587 | B2 * | 6/2004 | Thyssen et al. | 704/228 |
| 6,757,654 | B1 * | 6/2004 | Westerlund et al. | 704/262 |
| 6,931,373 | B1 * | 8/2005 | Bhaskar et al. | 704/230 |
| 6,959,274 | B1 * | 10/2005 | Gao et al. | 704/219 |
| 6,996,523 | B1 * | 2/2006 | Bhaskar et al. | 704/222 |
| 7,039,581 | B1 * | 5/2006 | Stachurski et al. | 704/205 |
| 7,139,959 | B2 * | 11/2006 | Hocevar | 714/752 |
| 7,191,122 | B1 * | 3/2007 | Gao et al. | 704/223 |
| 7,222,070 | B1 * | 5/2007 | Stachurski et al. | 704/207 |
| 7,590,525 | B2 * | 9/2009 | Chen | 704/211 |
| 7,590,531 | B2 * | 9/2009 | Khalil et al. | 704/228 |
| 7,657,427 | B2 * | 2/2010 | Jelinek | 704/208 |
| 7,668,712 | B2 * | 2/2010 | Wang et al. | 704/219 |
| 2002/0007273 | A1 * | 1/2002 | Chen | 704/229 |
| 2002/0052734 | A1 * | 5/2002 | Unno et al. | 704/207 |
| 2002/0091531 | A1 | 7/2002 | Kroon et al. | |
| 2003/0046064 | A1 * | 3/2003 | Moriya et al. | 704/201 |
| 2003/0078769 | A1 * | 4/2003 | Chen | 704/211 |
| 2003/0163305 | A1 | 8/2003 | Cheng et al. | |
| 2003/0172337 | A1 * | 9/2003 | Tsutsui et al. | 714/758 |
| 2003/0177011 | A1 | 9/2003 | Yasuda et al. | |
| 2004/0010407 | A1 | 1/2004 | Kovesi et al. | |
| 2004/0083110 | A1 | 4/2004 | Wang | |
| 2004/0128128 | A1 | 7/2004 | Wang et al. | |
| 2004/0184537 | A1 * | 9/2004 | Geiger et al. | 375/240.11 |
| 2004/0221209 | A1 | 11/2004 | Kupferschmidt et al. | |
| 2005/0027521 | A1 * | 2/2005 | Gavrilescu et al. | 704/230 |
| 2005/0154584 | A1 * | 7/2005 | Jelinek et al. | 704/219 |
| 2005/0163234 | A1 * | 7/2005 | Taleb | 375/259 |
| 2005/0165603 | A1 * | 7/2005 | Bessette et al. | 704/200.1 |
| 2006/0074643 | A1 * | 4/2006 | Lee et al. | 704/222 |
| 2007/0140499 | A1 * | 6/2007 | Davis | 381/23 |

FOREIGN PATENT DOCUMENTS

| | | | |
|---|---|---|---|
| JP | 2000059231 | A | 2/2000 |
| JP | 2002534702 | A | 10/2002 |
| JP | 2002372996 | A | 12/2002 |
| JP | 2004194048 | A | 7/2004 |
| JP | 2004533021 | A | 10/2004 |
| JP | 2007514977 | A | 6/2007 |
| WO | WO03001509 | A1 | 1/2003 |
| WO | 2005059900 | A1 | 6/2005 |

OTHER PUBLICATIONS

Taleb A et al., "Partial Spectral Loss Concealment in Transform Coders," International Conference on Acoustics, Speech, and signal Processing. Proceedings. (ICASSP '05), Mar. 18, 2005-Mar. 23, 2005, pp. 185-188, Philadelphia, Pennsylvania, USA.

Komaki N et al., "A Packet Loss Concealment Technique for VOIP Using Steganography," IEICE Transactions of Fundamentals of Electronics, Communications and Computer Sciences, Engineering Sciences Society, vol. E86-A, No. 8, Aug. 2003, pp. 2069-2072.

Schuyler Quackenbush et al., "Error Mitigation in MPEG-4 Audio Packet Communication Systems," 115th Audio Engineering Society Convention, Oct. 10, 2003-Oct. 13, 2003, pp. 1-11, New York, NY, USA.

International Search Report and Written Opinion—PCT/US2006/060237, International Search Authority—European Patent Office—Mar. 14, 2007.

* cited by examiner

ENCODER-ASSISTED FRAME LOSS CONCEALMENT TECHNIQUES FOR AUDIO CODING

This application claims the benefit of U.S. Provisional Application No. 60/730,459, filed Oct. 26, 2005, and U.S. Provisional Application No. 60/732,012, filed Oct. 31, 2005.

TECHNICAL FIELD

This disclosure relates to audio coding techniques and, more particularly, to frame loss concealment techniques for audio coding.

BACKGROUND

Audio coding is used in many applications and environments such as satellite radio, digital radio, internet streaming (web radio), digital music players, and a variety of mobile multimedia applications. There are many audio coding standards, such as standards according to the motion pictures expert group (MPEG), windows media audio (WMA), and standards by Dolby Laboratories, Inc. Many audio coding standards continue to emerge, including the MP3 standard and successors to the MP3 standard, such as the advanced audio coding (AAC) standard used in "iPod" devices sold by Apple Computer, Inc. Audio coding standards generally seek to achieve low bitrate, high quality audio coding using compression techniques. Some audio coding is "loss-less," meaning that the coding does not degrade the audio signal, while other audio coding may introduce some loss in order to achieve additional compression.

In many applications, audio coding is used with video coding in order to provide multi-media content for applications such as video telephony (VT) or streaming video. Video coding standards according to the MPEC, for example, often use audio and video coding. The MPEG standards currently include MPEG-1, MPEG-2 and MPEG-4, but other standards will likely emerge. Other exemplary video standards include the International Telecommunications Union (ITU) H.263 standards, ITU H.264 standards, QuickTime™ technology developed by Apple Computer Inc., Video for Windows™ developed by Microsoft Corporation, Indeo™ developed by Intel Corporation, RealVideo™ from RealNetworks, Inc., and Cinepak™ developed by SuperMac, Inc. Some audio and video standards are open source, while others remain proprietary. Many other audio and video coding standards will continue to emerge and evolve.

Bitstream errors occurring in transmitted audio signals may have a serious impact on decoded audio signals due to the introduction of audible artifacts. In order to address this quality degradation, an error control block including an error detection module and a frame loss concealment (FLC) module may be added to a decoder. Once errors are detected in a frame of the received bitstream, the error detection module discards all bits for the erroneous frame. The FLC module then estimates audio data to replace the discarded frame in an attempt to create a perceptually seamless sounding audio signal.

Various techniques for decoder frame loss concealment have been proposed. However, most FLC techniques suffer from the extreme tradeoff between concealed audio signal quality and implementation cost. For example, simply replacing the discarded frame with silence, noise, or audio data of a previous frame represents one extreme of the tradeoff due to the low computational cost but poor concealment performance. Advanced techniques based on source modeling to conceal the discarded frame fall on the other extreme by requiring high or even prohibitive implementation costs to achieve satisfactory concealment performance.

SUMMARY

In general, the disclosure relates to encoder-assisted frame loss concealment (FLC) techniques for decoding audio signals. Upon receiving an audio bitstream for a frame of an audio signal from an encoder, a decoder may perform error detection and discard the frame when errors are detected. The decoder may implement the encoder-assisted FLC techniques in order to accurately conceal the discarded frame based on neighboring frames and side-information transmitted with the audio bitstreams from the encoder. The encoder-assisted FLC techniques include estimating magnitudes of frequency-domain data for the frame based on frequency-domain data of neighboring frames, and estimating signs of the frequency-domain data based on a subset of signs transmitted from the encoder as side-information. In this way, the encoder-assisted FLC techniques may reduce the occurrence of audible artifacts to create a perceptually seamless sounding audio signal.

Frequency-domain data for a frame of an audio signal includes tonal components and noise components. Signs estimated from a random signal may be substantially accurate for the noise components of the frequency-domain data. However, to achieve highly accurate sign estimation for the tonal components, the encoder transmits signs for the tonal components of the frequency-domain data as side-information. In order to minimize the amount of the side-information transmitted to the decoder, the encoder does not transmit locations of the tonal components within the frame. Instead, both the encoder and the decoder self-derive the locations of the tonal components using the same operation. The encoder-assisted FLC techniques therefore achieve significant improvement of frame concealment quality at the decoder with a minimal amount of side-information transmitted from the encoder.

The encoder-assisted FLC techniques described herein may be implemented in multimedia applications that use an audio coding standard, such as the windows media audio (WMA) standard, the MP3 standard, and the AAC (Advanced Audio Coding) standard. In the case of the AAC standard, frequency-domain data of a frame of an audio signal is represented by modified discrete cosine transform (MDCT) coefficients. Each of the MDCT coefficients comprises either a tonal component or a noise component. A frame may include 1024 MDCT coefficients, and each of the MDCT coefficients includes a magnitude and a sign. The encoder-assisted FLC techniques separately estimate the magnitudes and signs of MDCT coefficients for a discarded frame.

In one embodiment, the disclosure provides a method of concealing a frame of an audio signal. The method comprises estimating magnitudes of frequency-domain data for the frame based on neighboring frames of the frame, estimating signs of frequency-domain data for the frame based on a subset of signs for the frame transmitted from an encoder as side-information, and combining the magnitude estimates and the sign estimates to estimate frequency-domain data for the frame.

In another embodiment, the disclosure provides a computer-readable medium comprising instructions for concealing a frame of an audio signal. The instructions cause a programmable processor to estimate magnitudes of frequency-domain data for the frame based on neighboring frames of the frame, and estimate signs of the frequency-domain data for the frame based on a subset of signs for the frame transmitted from an encoder as side-information. The instructions also cause the programmable processor to combine the magnitude estimates and the sign estimates to estimate frequency-domain data for the frame.

In a further embodiment, the disclosure provides a system for concealing a frame of an audio signal comprising an encoder that transmits a subset of signs for the frame as side-information, and a decoder including a FLC module that receives the side-information for the frame from the encoder. The FLC module within the decoder estimates magnitudes of frequency-domain data for the frame based on neighboring frames of the frame, estimates signs of frequency-domain data for the frame based on the received side-information, and combines the magnitude estimates and the sign estimates to estimate frequency-domain data for the frame.

In another embodiment, the disclosure provides an encoder comprising a component selection module that selects components of frequency-domain data for a frame of an audio signal, and a sign extractor that extracts a subset of signs for the selected components from the frequency-domain data for the frame. The encoder transmits the subset of signs for the frame to a decoder as side-information.

In a further embodiment, the disclosure provides a decoder comprising a FLC module including a magnitude estimator that estimates magnitudes of frequency-domain data for a frame of an audio signal based on neighboring frames of the frame, and a sign estimator that estimates signs of frequency-domain data for the frame based on a subset of signs for the frame transmitted from an encoder as side-information. The decoder combines the magnitude estimates and the sign estimates to estimate frequency-domain data for the frame.

The techniques described herein may be implemented in hardware, software, firmware, or any combination thereof. If implemented in software, the techniques may be realized in part by a computer readable medium comprising program code containing instructions that, when executed by a programmable processor, performs one or more of the methods described herein.

The details of one or more embodiments are set forth in the accompanying drawings and the description below. Other features, objects, and advantages of the invention will be apparent from the description and drawings, and from the claims.

DETAILED DESCRIPTION

Figure 1:
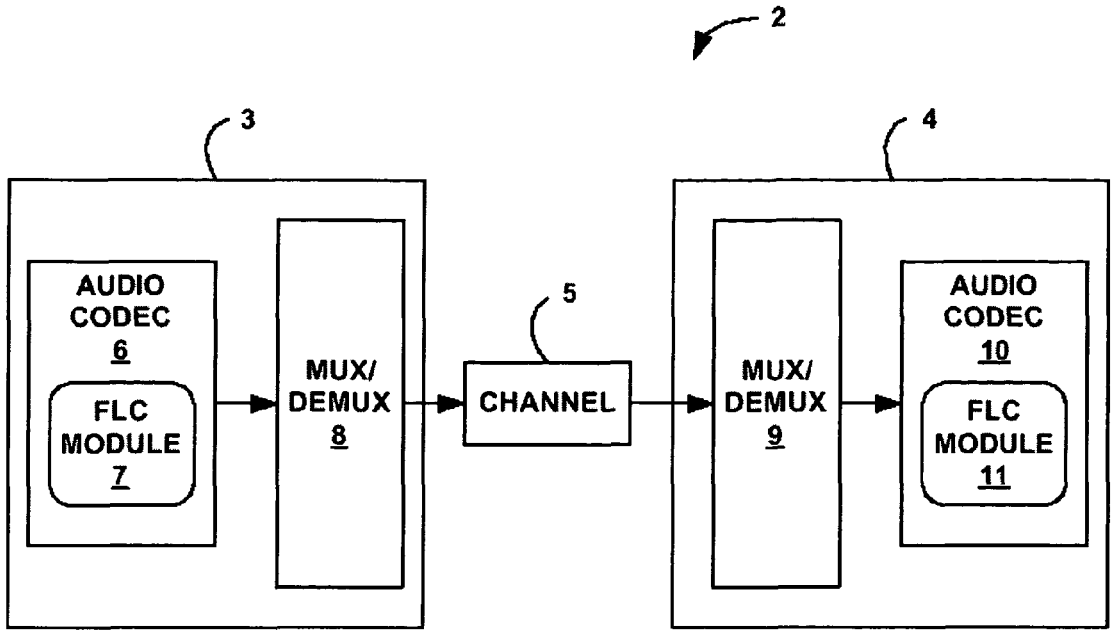
FIG. 1 is a block diagram illustrating an audio encoding and decoding system incorporating audio encoder-decoders (codecs) that implement encoder-assisted frame loss concealment (FLC) techniques.

FIG. 1 is a block diagram illustrating an audio encoding and decoding system 2 incorporating audio encoder-decoders (codecs) that implement encoder-assisted frame loss concealment (FLC) techniques. As shown in FIG. 1, system 2 includes a first communication device 3 and a second communication device 4. System 2 also includes a transmission channel 5 that connects communication devices 3 and 4. System 2 supports two-way audio data transmission between communication devices 3 and 4 over transmission channel 5.

In the illustrated embodiment, communication device 3 includes an audio codec 6 with a FLC module 7 and a multiplexing (mux)/demultiplexing (demux) component 8. Communication device 4 includes a mux/demux component 9 and an audio codec 10 with a FLC module 11. FLC modules 7 and 11 of respective audio codecs 6 and 10 may accurately conceal a discarded frame of an audio signal based on neighboring frames and side-information transmitted from an encoder, in accordance with the encoder-assisted FLC techniques described herein. In other embodiments, FLC modules 7 and 11 may accurately conceal multiple discarded frames of an audio signal based on neighboring frames at the expense of additional side-information transmitted from an encoder.

Communication devices 3 and 4 may be configured to send and receive audio data. Communication devices 3 and 4 may be implemented as wireless mobile terminals or wired terminals. To that end, communication devices 3 and 4 may further include appropriate wireless transmitter, receiver, modem, and processing electronics to support wireless communication. Examples of wireless mobile terminals include mobile radio telephones, mobile personal digital assistants (PDAs), mobile computers, or other mobile devices equipped with wireless communication capabilities and audio encoding and/or decoding capabilities. Examples of wired terminals include desktop computers, video telephones, network appliances, set-top boxes, interactive televisions, or the like.

Transmission channel 5 may be a wired or wireless communication medium. In wireless communication, bandwidth is a significant concern as extremely low bitrates are often required. In particular, transmission channel 5 may have limited bandwidth, making the transmission of large amounts of audio data over channel 5 very challenging. Transmission channel 5, for example, may be a wireless communication link with limited bandwidth due to physical constraints in channel 5, or possibly quality-of-service (QoS) limitations or bandwidth allocation constraints imposed by the provider of transmission channel 5.

Each of audio codecs 6 and 10 within respective communication devices 3 and 4 encodes and decodes audio data according to an audio coding standard, such as a standard according to the motion pictures expert group (MPEG), a standard by Dolby Laboratories, Inc., the windows media audio (WMA) standard, the MP3 standard, and the advanced audio coding (AAC) standard. Audio coding standards generally seek to achieve low bitrate, high quality audio coding using compression techniques. Some audio coding is "lossless," meaning that the coding does not degrade the audio signal, while other audio coding may introduce some loss in order to achieve additional compression.

In some embodiments, communication device 3 and 4 may also include video codecs (not shown) integrated with respective audio codecs 6 and 10, and include appropriate mux/demux components 8 and 9 to handle audio and video portions of a data stream. The mux/demux components 8 and 9 may conform to the International Telecommunications Union (ITU) H.223 multiplexer protocol, or other protocols such as the user datagram protocol (UDP).

Audio coding may be used with video coding in order to provide multimedia content for applications such as video telephony (VT) or streaming video. Video coding standards according to the MPEG, for example, often use audio and video coding. The MPEG standards currently include MPEG-1, MPEG-2 and MPEG-4, but other standards will likely emerge. Other exemplary video standards include the ITU H.263 standards, ITU H.264 standards, QuickTime™ technology developed by Apple Computer Inc., Video for Windows™ developed by Microsoft Corporation, Indeo™ developed by Intel Corporation, RealVideo™ from RealNetworks, Inc., and Cinepak™ developed by SuperMac, Inc.

For purposes of illustration, it will be assumed that each of communication devices 3 and 4 is capable of operating as both a sender and a receiver of audio data. For audio data transmitted from communication device 3 to communication device 4, communication device 3 is the sender device and communication device 4 is the recipient device. In this case, audio codec 6 within communication device 3 may operate as an encoder and audio codec 10 within communication device 4 may operate as a decoder. Conversely, for audio data transmitted from communication device 4 to communication device 3, communication device 3 is the recipient device and communication device 4 is the sender device. In this case, audio codec 6 within communication device 3 may operate as a decoder and audio codec 10 within communication device 4 may operate as an encoder. The techniques described herein may also be applicable to devices that only send or only receive such audio data.

According to the disclosed techniques, communication device 4 operating as a recipient device receives an audio bitstream for a frame of an audio signal from communication device 3 operating as a sender device. Audio codec 10 operating as a decoder within communication device 4 may perform error detection and discard the frame when errors are detected. Audio codec 10 may implement the encoder-assisted FLC techniques to accurately conceal the discarded frame based on side-information transmitted with the audio bitstreams from communication device 3. The encoder-assisted FLC techniques include estimating magnitudes of frequency-domain data for the frame based on frequency-domain data of neighboring frames, and estimating signs of the frequency-domain data based on a subset of signs transmitted from the encoder as side-information.

Frequency-domain data for a frame of an audio signal includes tonal components and noise components. Signs estimated from a random signal may be substantially accurate for the noise components of the frequency-domain data. However, to achieve highly accurate sign estimation for the tonal components, an encoder transmits signs for the tonal components of the frequency-domain data to a decoder as side-information.

For example, FLC module 11 of audio codec 10 operating as a decoder within communication device 4 may include a magnitude estimator, a component selection module, and a sign estimator, although these components are not illustrated in FIG. 1. The magnitude estimator copies frequency-domain data from a neighboring frame of the audio signal. The magnitude estimator then scales energies of the copied frequency-domain data to estimate magnitudes of frequency-domain data for the discarded frame. The component selection module discriminates between tonal components and noise components of the frequency-domain data for the frame. In this way, the component selection module derives locations of the tonal components within the frame. The sign estimator only estimates signs for the tonal components selected by the component selection module based on a subset of signs for the frame transmitted from communication device 3 as side-information. Audio codec 10 operating as a decoder then combines the sign estimates for the tonal components with the corresponding magnitude estimates.

Audio codec 6 operating as an encoder within communication device 3 may include a component selection module and a sign extractor, although these components are not illustrated in FIG. 1. The component selection module discriminates between tonal components and noise components of the frequency-domain data for the frame. In this way, the component selection module derives locations of the tonal components within the frame. The sign extractor extracts a subset of signs for the tonal components selected by the component selection module. The extracted signs are then packed into an encoded audio bitstream as side-information. For example, the subset of signs for the frame may be attached to an audio bitstream for a neighboring frame.

In order to minimize the amount of the side-information transmitted across transmission channel 5, audio codec 6 operating as an encoder does not transmit the locations of the tonal components within the frame along with the subset of signs for the tonal components. Instead, both audio codecs 6 and 10 self-derive the locations of the tonal components using the same operation. In other words, audio codec 6 operating as an encoder carries out the same component selection operation as audio codec 10 operating as a decoder. In this way, the encoder-assisted FLC techniques achieve significant improvement of frame concealment quality at the decoder with a minimal amount of side-information transmitted from the encoder.

In the case of audio codecs 6 and 10 utilizing the AAC standard, frequency-domain data of a frame of an audio signal is represented by modified discrete cosine transform (MDCT) coefficients. A frame may include 1024 MDCT coefficients, and each of the MDCT coefficients includes a magnitude and a sign. Some of the MDCT coefficients comprise tonal components and the remaining MDCT coefficients comprise noise components. Audio codecs 6 and 10 may implement the encoder-assisted FLC techniques to separately estimate the magnitudes and signs of MDCT coefficients for a discarded frame. In the case of other audio standards, other types of transform coefficients may represent the frequency-domain data for a frame. In addition, the frame may include any number of coefficients.

Figure 2:
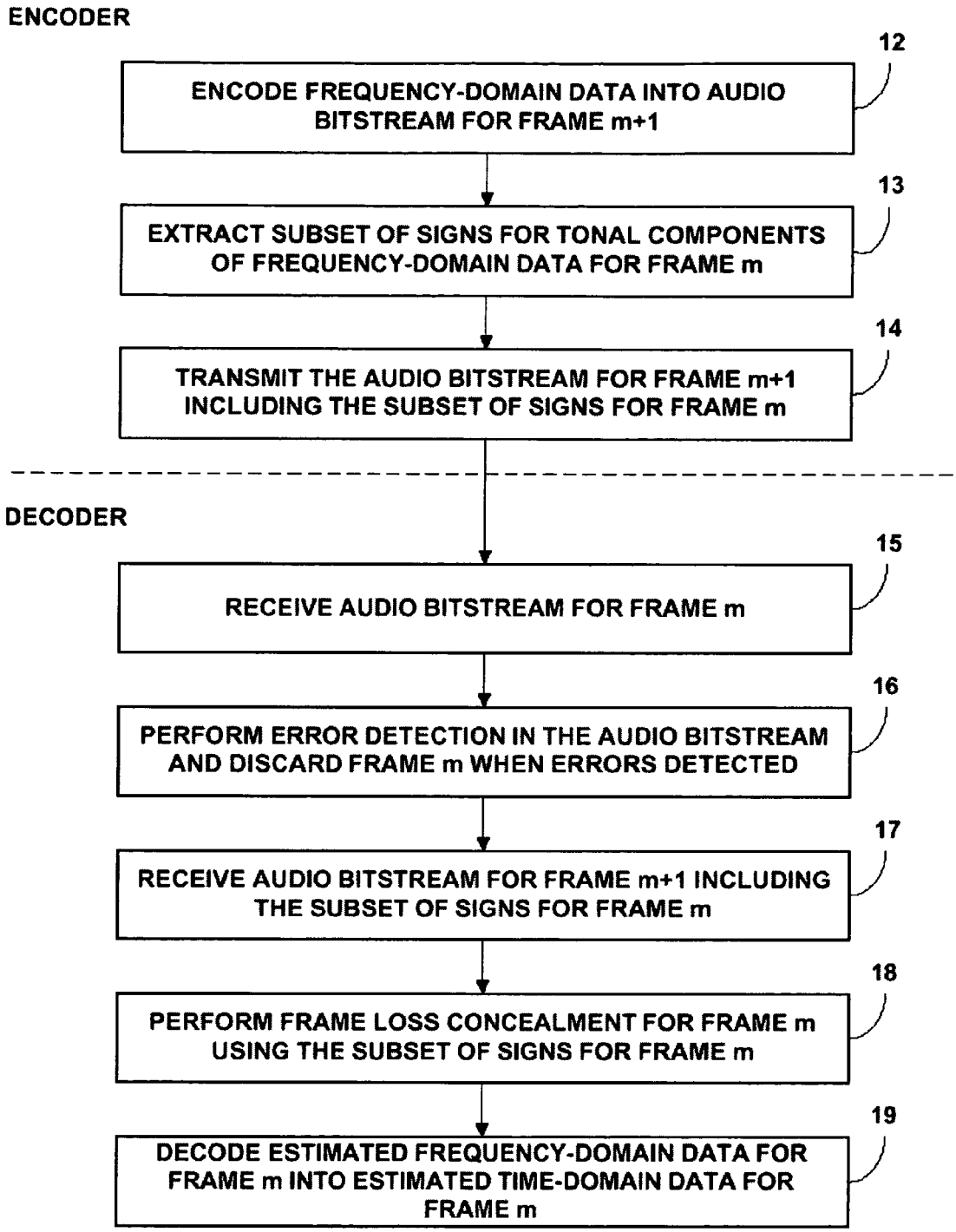
FIG. 2 is a flowchart illustrating an example operation of performing encoder-assisted frame loss concealment with the audio encoding and decoding system from FIG. 1.

FIG. 2 is a flowchart illustrating an example operation of performing encoder-assisted frame loss concealment with audio encoding and decoding system 2 from FIG. 1. For purposes of illustration, communication device 3 will operate as a sender device with audio codec 6 operating as an encoder, and communication device 4 will operate as a receiver device with audio codec 10 operating as a decoder.

Communication device 3 samples an audio signal for a frame m+1 and audio codec 6 within communication device 3 transforms the time-domain data into frequency-domain data for frame m+1. Audio codec 6 then encodes the frequency-domain data into an audio bitstream for frame m+1 (12). Audio codec 6 is capable of performing a frame delay to generate frequency-domain data for a frame m. The frequency-domain data includes tonal components and noise components. Audio codec 6 extracts a subset of signs for tonal components of the frequency-domain data for frame m (13).

In one embodiment, audio codec 6 utilizes FLC module 7 to extract the subset of signs for the tonal components of the frequency-domain data for frame m based on an estimated index subset. The estimated index subset identifies locations of the tonal components within frame m from estimated magnitudes of the frequency-domain data for frame m. FLC module 7 may include a magnitude estimator, a component selection module, and a sign extractor, although these components of FLC module 7 are not illustrated in FIG. 1. The component selection module may generate the estimated index subset based on the estimated magnitudes of the frequency-domain data for frame m from the magnitude estimator.

In another embodiment, audio codec 6 extracts the subset of signs for the tonal components of the frequency-domain data for frame m based on an index subset that identifies locations of tonal components within frame m+1 from magnitudes of the frequency-domain data for frame m+1. In this case, it is assumed that an index subset for frame m would be approximately equivalent to the index subset for frame m+1. Audio codec 6 may include a component selection module and a sign extractor, although these components are not illustrated in FIG. 1. The component selection module may generate the index subset based on the magnitudes of the frequency-domain data for frame m+1.

Audio codec 6 attaches the subset of signs for the tonal components of frame m to the audio bitstream for frame m+1 as side-information. Audio codec 6 does not attach the locations of the tonal components to the audio bitstream for frame m+1. Instead, both audio codecs 6 and 10 self-derive the locations of the tonal components using the same operation. In this way, the techniques minimize the amount of side-information to be attached to the audio bitstream for frame m+1. Communication device 3 then transmits the audio bitstream for frame m+1 including the subset of signs for frame m through transmission channel 5 to communication device 4 (14).

Communication device 4 receives an audio bitstream for frame m (15). Audio codec 10 within communication device 4 performs error detection on the audio bitstream and discards frame m when errors are found in the audio bitstream (16). Communication device 4 receives an audio bitstream for frame m+1 including a subset of signs for tonal components of frame m (17). Audio codec 10 then uses FLC module 11 to perform frame loss concealment for the discarded frame m by using the subset of signs for tonal components of frame m transmitted with the audio bitstream for frame m+1 from communication device 3 (18). FLC module 11 may include a magnitude estimator, a component selection module, and a sign estimator, although these components of FLC module 11 are not illustrated in FIG. 1.

The magnitude estimator within FLC module 11 may estimate magnitudes of frequency-domain data for frame m based on frequency-domain data for neighboring frames m−1 and m+1. In one embodiment, the component selection module may generate an estimated index subset that identifies locations of the tonal components within frame m based on the estimated magnitudes of the frequency-domain data for frame m from the magnitude estimator. The sign estimator then estimates signs for the tonal components within frame m from the subset of signs for frame m based on the estimated index subset for frame m.

In another embodiment, the component selection module may generate an index subset that identifies locations of tonal components within frame m+1 from magnitudes of the frequency-domain data for frame m+1. In this case, it is assumed that an index subset for frame m would be approximately equivalent to the index subset for frame m+1. The sign estimator then estimates signs for the tonal components within frame m from the subset of signs for frame m based on the index subset for frame m+1.

The sign estimator within FLC module 1 may estimate signs for noise components within frame m from a random signal. Audio codec 10 then combines the sign estimates for the tonal components and the noise components with the corresponding magnitude estimates to estimate frequency-domain data for frame m. Audio codec 10 then decodes the estimated frequency-domain data for frame m into estimated time-domain data of the audio signal for frame m (19).

Figure 3:
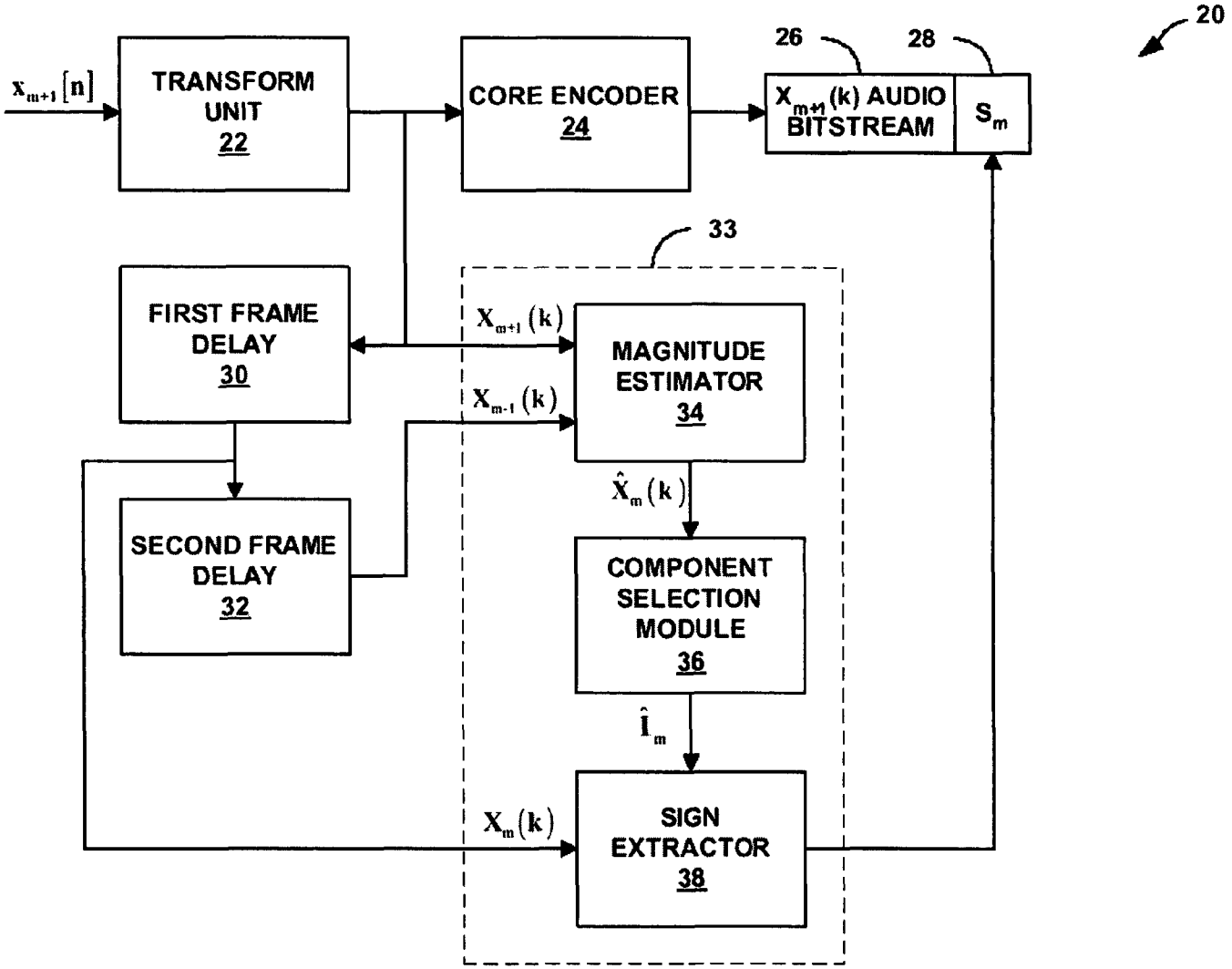
FIG. 3 is a block diagram illustrating an example audio encoder including a frame loss concealment module that generates a subset of signs for a frame to be transmitted as side-information.

FIG. 3 is a block diagram illustrating an example audio encoder 20 including a FLC module 33 that generates a subset of signs for a frame to be transmitted as side-information. Audio encoder 20 may be substantially similar to audio codecs 6 and 10 within respective communication devices 3 and 4 from FIG. 1. As illustrated in FIG. 3, audio encoder 20 includes a transform unit 22, a core encoder 24, a first frame delay 30, a second frame delay 32, and FLC module 33. For purposes of illustration, audio encoder 20 will be described herein as conforming to the AAC standard in which frequency-domain data of a frame of an audio signal is represented by MDCT coefficients. In addition, transform unit 22 will be described as a modified discrete cosine transform unit. In other embodiments, audio encoder 20 may conform to any of the audio coding standards listed above, or other standards.

The techniques will be described herein as concealing a frame m of an audio signal. Frame m+1 represents the audio frame that immediately follows frame m of the audio signal. Similarly, frame m−1 represents the audio frame that immediately precedes frame m of the audio signal. In other embodiments, the encoder-assisted FLC techniques may utilize neighboring frames of frame m that do not immediate precede or follow frame m to conceal frame m.

Transform unit 22 receives samples of an audio signal $x_{m+1}[n]$ for frame m+1 and transforms the samples into coefficients $X_{m+1}(k)$. Core encoder 24 then encodes the coefficients into an audio bitstream 26 for frame m+1. FLC module 33 uses coefficients $X_{m+1}(k)$ for frame m+1 as well as coefficients $X_m(k)$ for frame m and $X_{m-1}(k)$ for frame m−1 to generate a subset of signs $S_m$ 28 for tonal components of coefficients $X_m(k)$ for frame m. FLC module 33 attaches the subset of signs $S_m$ 28 to audio bitstream 26 for frame m+1 as side-information.

FLC module 33 includes a magnitude estimator 34, a component selection module 36, and a sign extractor 38. Transform unit 22 sends the coefficients $X_{m+1}(k)$ for frame m+1 to magnitude estimator 34 and first frame delay 30. First frame delay 30 generates coefficients $X_m(k)$ for frame m and sends the coefficients for frame m to second frame delay 32. Second frame delay 32 generates coefficients $X_{m-1}(k)$ for frame m−1 and sends the coefficients for frame m−1 to magnitude estimator 34.

Magnitude estimator 34 estimates magnitudes of coefficients for frame m based on the coefficients for frames m+1 and m−1. Magnitude estimator 34 may implement one of a variety of interpolation techniques to estimate coefficient magnitudes for frame m. For example, magnitude estimator 34 may implement energy interpolation based on the energy of the previous frame coefficient $X_{m-1}(k)$ for frame m−1 and the next frame coefficient $X_{m+1}(k)$ for frame m+1. The magnitude estimation is given below:

$$\hat{X}_m(k)=|\alpha(k)X_{m-1}(k)|, \tag{1}$$

where $\alpha(k)$ is an energy scaling factor computed by $$\alpha^2(k)=\frac{\sum_{k\in B_b}|X_{m+1}(k)|^2}{\sum_{k\in B_b}|X_{m-1}(k)|^2}, \tag{2}$$

where $B_b$ is the set of the MDCT coefficients in the $b^{th}$ scale factor band. In other embodiments, magnitude estimator 44 may utilize neighboring frames of frame m that do not immediate precede or follow frame m to estimate magnitudes of coefficients for frame m.

Magnitude estimator 34 then sends the estimated coefficient magnitudes $\hat{X}_m(k)$ for frame m to component selection module 36. Component selection module 36 differentiates between tonal components and noise components of frame m by sorting the estimated coefficient magnitudes for frame m. The coefficients with the largest magnitudes or most prominent spectral peaks may be considered tonal components and the remaining coefficients may be considered noise components.

The number of tonal components selected may be based on a predetermined number of signs to be transmitted. For example, ten of the coefficients with the highest magnitudes may be selected as tonal components of frame m. In other cases, component selection module 36 may select more or less than ten tonal components. In still other cases, the number of tonal component selected for frame m may vary based on the audio signal. For example, if the audio signal includes a larger number of tonal components in frame m than in other frames of the audio signal, component selection module 36 may select a larger number of tonal components from frame m than from the other frames.

In other embodiments, component selection module 36 may select the tonal components from the estimated coefficient magnitudes for frame m using a variety of other schemes to differentiate between tonal components and noise components of frame m. For example, component selection module 36 may select a subset of coefficients based on some psychoacoustic principles. FLC module 43 may employ more accurate component differentiation schemes as the complexity level of audio encoder 20 allows.

Component selection module 36 then generates an estimated index subset $\hat{I}_m$ that identifies locations of the tonal components selected from the estimated coefficient magnitudes for frame m. The tonal components are chosen as the coefficients for frame m having the most prominent magnitudes. However, the coefficients for frame m are not available to an audio decoder when performing concealment of frame m. Therefore, the index subset is derived based on the estimated coefficients magnitudes $\hat{X}_m(k)$ for frame m and referred to as the estimated index subset. The estimate index subset is given below:

$$\hat{I}_m\cong\{k\,|\,|\hat{X}_m(k)|>\mathrm{Thr},0<k<M\}, \tag{3}$$

where M is the number of MDCT coefficients within frame m, Thr is a threshold determined such that $|\hat{I}_m|=B_m$, and $B_m$ is the number of signs to be transmitted. For example, $B_m$ may be equal to ten signs in an exemplary embodiment. In other embodiments, $B_m$ may be more or fewer than 10. In still other embodiments, $B_m$ may vary based on the audio signal of frame m.

Component selection module 36 sends the estimated index subset for frame m to sign extractor 38. Sign extractor 38 also receives the coefficients $X_m(k)$ for frame m from first frame delay 30. Sign extractor 38 then extracts signs from coefficients $X_m(k)$ for frame m identified by the estimated index subset. For example, the estimated index subset includes a predetermined number, e.g., 10, of coefficient indices that identify the tonal components selected from the estimated coefficient magnitudes for frame m. Sign extractor 38 then extracts signs corresponding to the coefficients $X_m(k)$ for frame m with indices k equal to the indices within the estimated index subset. Sign extractor 38 then attaches the subset of signs $S_m$ 28 extracted from tonal components for frame m identified by the estimated index subset to audio bitstream 26 for frame m+1.

Component selection module 36 selects tonal components within frame m using the same operation as an audio decoder receiving transmissions from audio encoder 20. Therefore, the same estimated index subset $\hat{I}_m$ that identifies locations of the tonal components selected from estimated coefficient magnitudes for frame m may be generated in both audio encoder 20 and an audio decoder. The audio decoder may then apply the subset of signs $S_m$ 28 for tonal components of frame m to the appropriate estimated coefficient magnitudes of frame m identified by the estimated index subset. In this way, the amount of side-information transmitted may be minimized as audio encoder 20 does not need to transmit the locations of the tonal components within frame m along with the subset of signs $S_m$ 28.

Figure 4:
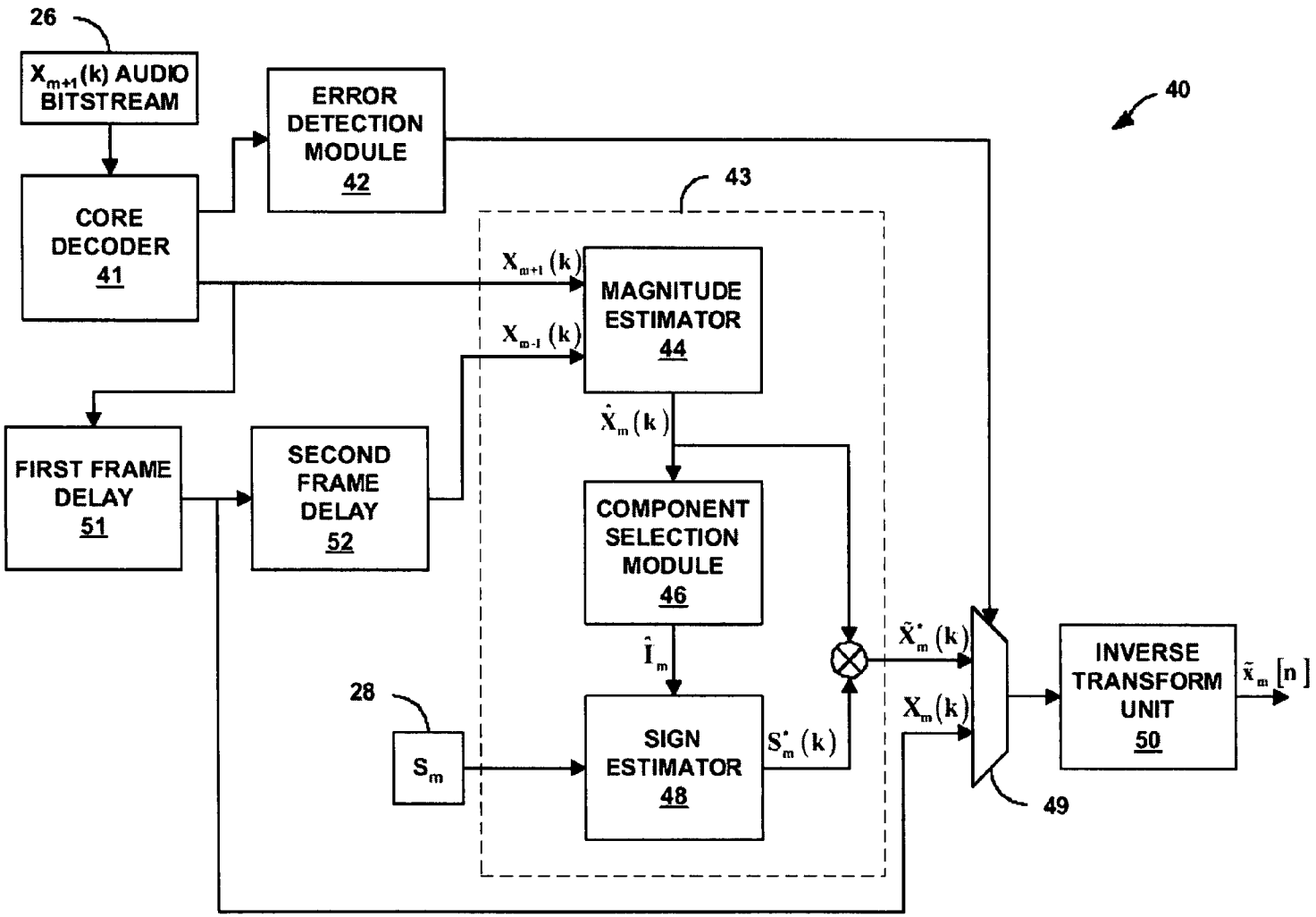
FIG. 4 is a block diagram illustrating an example audio decoder including a frame loss concealment module that utilizes a subset of signs for a frame received from an encoder as side-information.

FIG. 4 is a block diagram illustrating an example audio decoder 40 including a frame loss concealment module 43 that utilizes a subset of signs for a frame received from an encoder as side-information. Audio decoder 40 may be substantially similar to audio codecs 6 and 10 within respective communication devices 3 and 4 from FIG. 1. Audio decoder 40 may receive audio bitstreams from an audio encoder substantially similar to audio encoder 20 from FIG. 3. As illustrated in FIG. 4, audio decoder 40 includes a core decoder 41, an error detection module 42, FLC module 43, and an inverse transform unit 50.

For purposes of illustration, audio decoder 40 will be described herein as conforming to the AAC standard in which frequency-domain data of a frame of an audio signal is represented by MDCT coefficients. In addition, inverse transform unit 50 will be described as an inverse modified discrete cosine transform unit. In other embodiments, audio decoder 40 may conform to any of the audio coding standards listed above.

Core decoder 41 receives an audio bitstream for frame m including coefficients $X_m(k)$ and sends the audio bitstream for frame m to an error detection module 42. Error detection module 42 then performs error detection on the audio bitstream for frame m. Core decoder 41 subsequently receives audio bitstream 26 for frame m+1 including coefficients $X_{m+1}(k)$ and subset of signs $S_m$ 28 for frame m as side-information. Core decoder 41 uses first frame delay 51 to generate coefficients for frame m, if not discarded, and second frame delay 52 to generate coefficients for frame m−1 from the audio bitstream for frame m+1. If the coefficients for frame m are not discarded, first frame delay 51 sends the coefficients for frame m to multiplexer 49. Second frame delay 52 sends the coefficients for frame m−1 to FLC module 43.

If errors are not detected within frame m, error detection module 42 may enable multiplexer 49 to pass coefficients $X_m(k)$ for frame m directly from first frame delay 51 to inverse transform unit 50 to be transformed into audio signal samples for frame m.

If errors are detected within frame m, error detection module 42 discards all of the coefficients for frame m and enables multiplexer 49 to pass coefficient estimates $\tilde{X}^*_m(k)$ for frame m from FLC module 43 to inverse transform unit 50. FLC module 43 receives coefficients $X_{m+1}(k)$ for frame m+1 from core decoder 41 and receives coefficients $X_{m-1}(k)$ for frame m−1 from second frame delay 52. FLC module 43 uses the coefficients for frames m+1 and m−1 to estimate magnitudes of coefficients for frame m. In addition, FLC module 43 uses the subset of signs $S_m$ 28 for frame m transmitted with audio bitstream 26 for frame m+1 from audio encoder 20 to estimate signs of coefficients for frame m. FLC module 43 then combines the magnitude estimates and sign estimates to estimate coefficients for frame m. FLC module 43 sends the coefficient estimates $\tilde{X}^*_m(k)$ to inverse transform unit 50, which transforms the coefficient estimates for frame m into estimated samples of the audio signal for frame m, $\tilde{x}_m[n]$.

FLC module 43 includes a magnitude estimator 44, a component selection module 46, and a sign estimator 48. Core decoder 41 sends the coefficients $X_{m+1}(k)$ for frame m+1 to magnitude estimator 44 and second frame delay 52 sends the coefficients $X_{m-1}(k)$ for frame m−1 to magnitude estimator 44. Substantially similar to magnitude estimator 34 within audio encoder 20, magnitude estimator 44 estimates magnitudes of coefficients for frame m based on the coefficients for frames m+1 and m−1. Magnitude estimator 44 may implement one of a variety of interpolation techniques to estimate coefficient magnitudes for frame m. For example, magnitude estimator 44 may implement energy interpolation based on the energy of the previous frame coefficient $X_{m-1}(k)$ for frame m−1 and the next frame coefficient $X_{m+1}(k)$ for frame m+1. The magnitude estimation is given above in equation (1). In other embodiments, magnitude estimator 44 may utilize neighboring frames of frame m that do not immediate precede or follow frame m to estimate magnitudes of coefficients for frame m.

Magnitude estimator 44 then sends the estimated coefficient magnitudes $\hat{X}_m(k)$ for frame m to component selection module 46. Component selection module 46 differentiates between tonal components and noise components of frame m by sorting the estimated coefficient magnitudes for frame m. The coefficients with the largest magnitudes or most prominent spectral peaks may be considered tonal components and the remaining coefficients may be considered noise components. The number of tonal components selected may be based on a predetermined number of signs to be transmitted. In other cases, the number of tonal component selected for frame m may vary based on the audio signal. Component selection module 46 then generates an estimated index subset $\hat{I}_m$ that identifies locations of the tonal components selected from the estimated coefficient magnitudes for frame m. The estimated index subset is given above in equation (3).

Component selection module 46 selects tonal components within frame m using the exact same operation as component selection module 36 within audio encoder 20, from which the audio bitstreams are received. Therefore, the same estimated index subset $\hat{I}_m$ that identifies locations of the tonal components selected from estimated coefficient magnitudes for frame m may be generated in both audio encoder 20 and audio decoder 40. Audio decoder 40 may then apply the subset of signs $S_m$ 28 for tonal components of frame m to the appropriate estimated coefficient magnitudes of frame m identified by the estimated index subset.

Component selection module 46 sends the estimated index subset for frame m to sign estimator 48. Sign estimator 48 also receives the subset of signs $S_m$ 28 for frame m transmitted with the audio bitstream 26 for frame m+1 from audio encoder 20. Sign estimator 48 then estimates signs for both tonal components and noise components for frame m.

In the case of noise components, sign estimator 48 estimates signs from a random signal. In the case of tonal components, sign estimator 48 estimates signs from the subset of signs $S_m$ 28 based on the estimated index subset $\hat{I}_m$. For example, the estimated index subset includes a predetermined number, e.g., 10, of coefficient indices that identify the tonal components selected from the estimated coefficient magnitudes for frame m. Sign estimator 48 then estimates signs for the tonal components of frame m as the subset of signs $S_m$ 28 with indices k equal to the indices within the estimated index subset. The sign estimates $S^*_m(k)$ are given below:

$$S^*_m(k) = \begin{cases} sgn(X_m(k)), \text{ for } k \in \hat{I}_m \\ S_m(k), \text{ for } k \notin \hat{I}_m, \end{cases} \tag{4}$$

where sgn( ) denotes the sign function, $\hat{I}_m$ is the estimated index subset of the coefficients corresponding to the selected tonal components, and $S_m(k)$ is a random variable with sample space $\{-1, 1\}$.

As described above, in order to estimate signs for the tonal components of frame m, audio decoder 40 needs to know the location of the tonal components within frame m as well as the corresponding signs of the original tonal components of frame m. A simple way for audio decoder 40 to receive this information would be to explicitly transmit both parameters from audio encoder 20 to audio decoder 40 at the expense of increased bit-rate. In the illustrated embodiment, estimated index subset $\hat{I}_m$ is self-derived at both audio encoder 20 and audio decoder 40 using the exact same derivation process, whereas the signs for the tonal components of frame m indexed by estimated index subset $\hat{I}_m$ are transmitted from audio encoder 20 as side-information.

FLC module 43 then combines the magnitude estimates $\hat{X}_m(k)$ from magnitude estimator 44 and the sign estimates $S^*_m(k)$ from sign estimator 48 to estimate coefficients for frame m. The coefficient estimates $\tilde{X}^*_m(k)$ for frame m are given below:

$$\tilde{X}^*_m(k)=S^*_m(k)\hat{X}_m(k)=S^*_m(k)|\alpha(k)X_{m-1}(k)|. \tag{5}$$

FLC module 43 then sends the coefficient estimates to inverse transform unit 50 via multiplexer 49 enabled to pass coefficient estimates for frame m, which transforms the coefficients estimates for frame m into estimated samples of the audio signal for frame m, $\tilde{x}_m[n]$.

Figure 5:
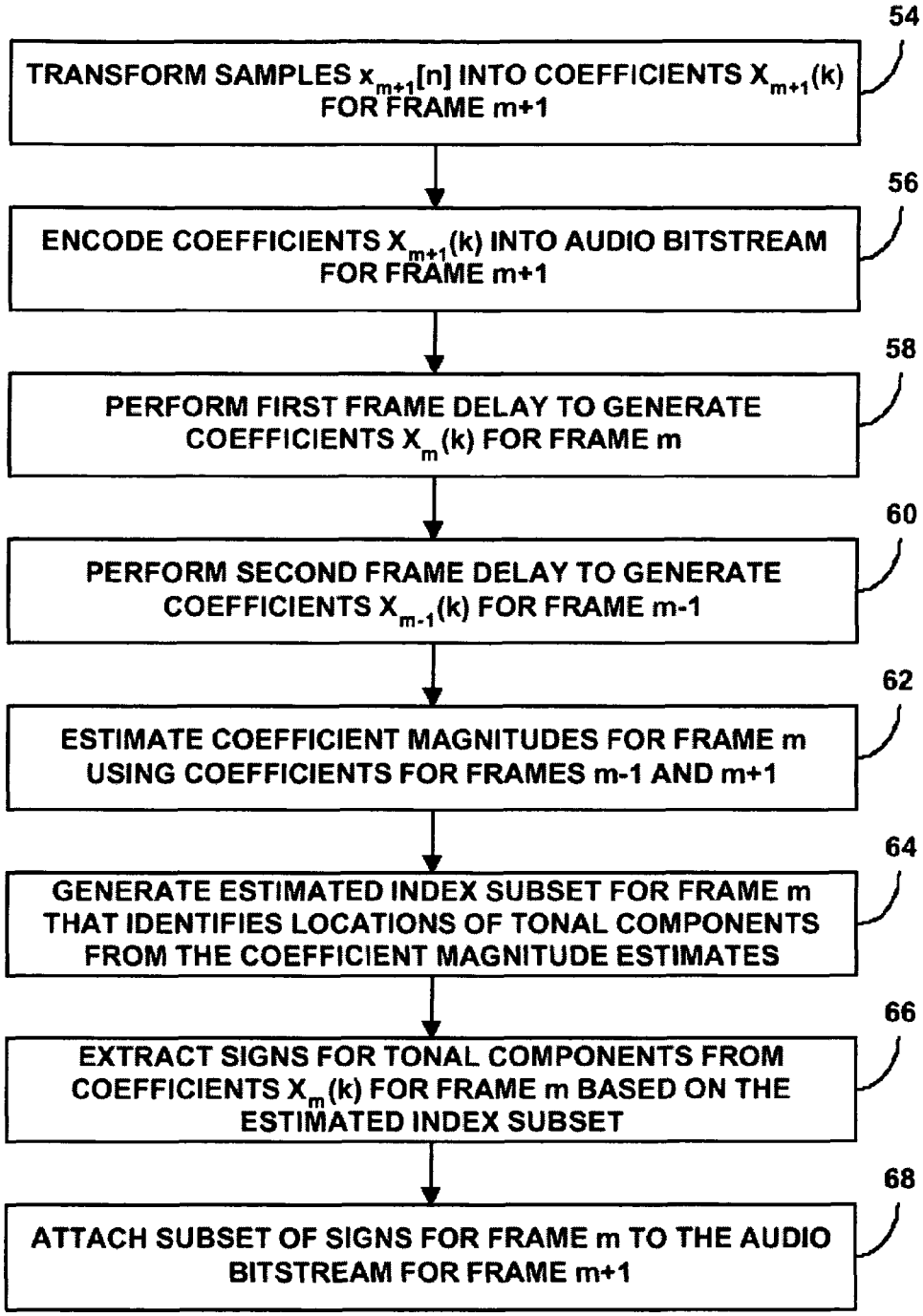
FIG. 5 is a flowchart illustrating an exemplary operation of encoding an audio bitstream and generating a subset of signs for a frame to be transmitted with the audio bitstream as side-information.

FIG. 5 is a flowchart illustrating an exemplary operation of encoding an audio bitstream and generating a subset of signs for a frame to be transmitted with the audio bitstream as side-information. The operation will be described herein in reference to audio encoder 20 from FIG. 3.

Transform unit 22 receives samples of an audio signal $x_{m+1}[n]$ for frame m+1 and transforms the samples into coefficients $X_{m+1}(k)$ for frame m+1 (54). Core encoder 24 then encodes the coefficients into an audio bitstream 26 for frame m+1 (56). Transform unit 22 sends the coefficients $X_{m+1}(k)$ for frame m+1 to magnitude estimator 34 and first frame delay 30. First frame delay 30 performs a frame delay and generates coefficients $X_m(k)$ for frame m (58). First frame delay 30 then sends the coefficients for frame m to second frame delay 32. Second frame delay 32 performs a frame delay and generates coefficients $X_{m-1}(k)$ for frame m−1 (60). Second frame delay 32 then sends the coefficients for frame m−1 to magnitude estimator 34.

Magnitude estimator 34 estimates magnitudes of coefficients for frame m based on the coefficients for frames m+1 and m−1 (62). For example, magnitude estimator 34 may implement the energy interpolation technique given in equation (1) to estimate coefficient magnitudes. Magnitude estimator 34 then sends the estimated coefficient magnitudes $\hat{X}_m(k)$ for frame m to component selection module 36. Component selection module 36 differentiates between tonal components and noise components of frame m by sorting the estimated coefficient magnitudes for frame m. The coefficients with the largest magnitudes may be considered tonal components and the remaining coefficients may be considered noise components. The number of tonal components selected may be based on a predetermined number of signs to be transmitted. In other cases, the number of tonal component selected for frame m may vary based on the audio signal. Component selection module 36 then generates an estimated index subset $\hat{I}_m$ that identifies locations of the tonal components selected from the estimated coefficient magnitudes for frame m (64).

Component selection module 36 sends the estimated index subset for frame m to sign extractor 38. Sign extractor 38 also receives the coefficients $X_m(k)$ for frame m from first frame delay 30. Sign extractor 38 then extracts signs from coefficients $X_m(k)$ for frame m identified by the estimated index subset (66). Sign extractor 38 then attaches the subset of signs $S_m$ 28 extracted from the tonal components for frame m identified by the estimated index subset to the audio bitstream 26 for frame m+1 (68).

Figure 6:
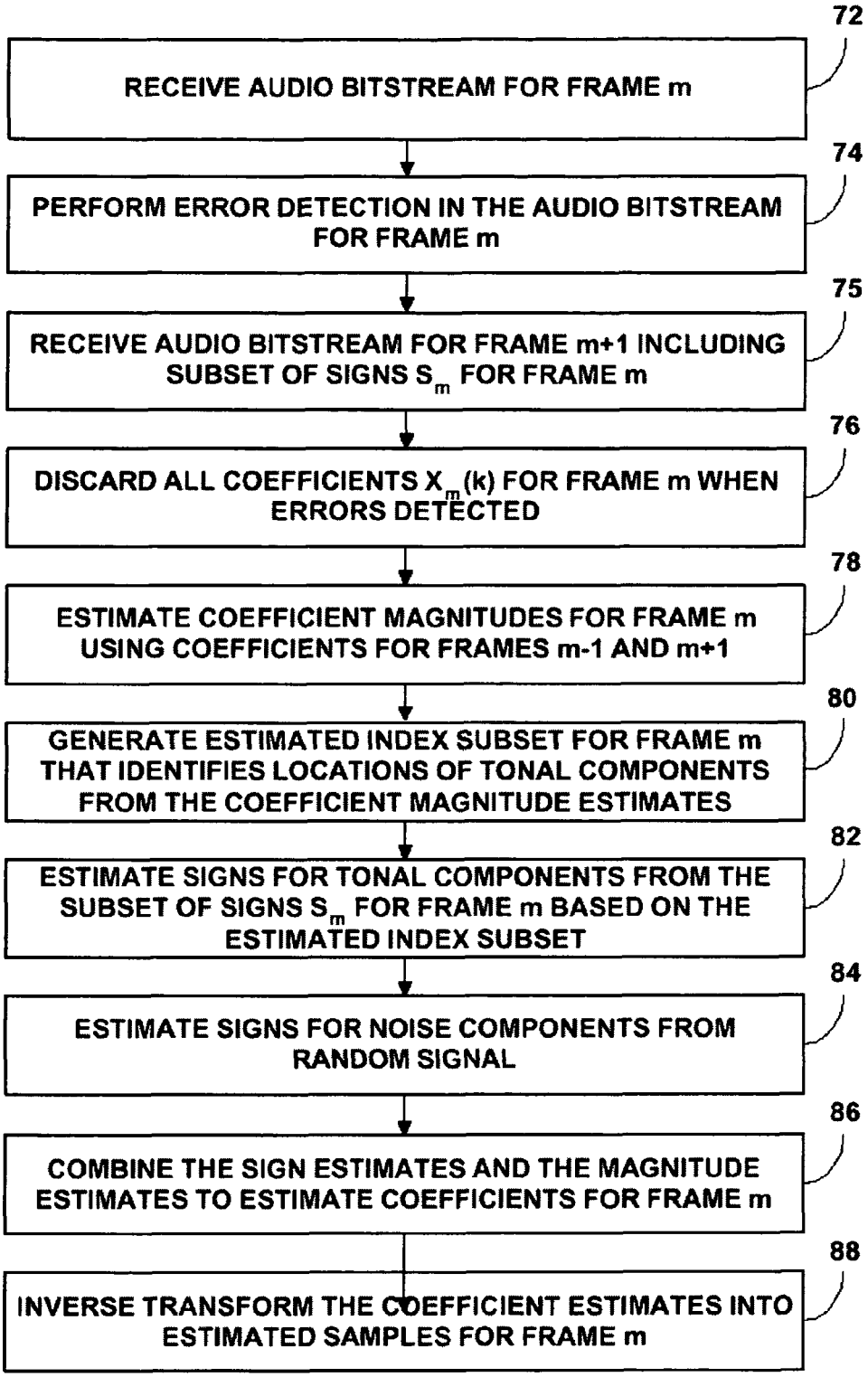
FIG. 6 is a flowchart illustrating an exemplary operation of decoding an audio bitstream and performing frame loss concealment using a subset of signs for a frame received from an encoder as side-information.

FIG. 6 is a flowchart illustrating an exemplary operation of decoding an audio bitstream and performing frame loss concealment using a subset of signs for a frame received from an encoder as side-information. The operation will be described herein in reference to audio decoder 40 from FIG. 4.

Core decoder 41 receives an audio bitstream for frame m including coefficients $X_m(k)$ (72). Error detection module 42 then performs error detection on the audio bitstream for frame m (74). Core decoder 41 subsequently receives audio bitstream 26 for frame m+1 including coefficients $X_{m+1}(k)$ and subset of signs $S_m$ 28 for frame m as side-information (75). Core decoder 41 uses first frame delay 51 to generate coefficients for frame m, if not discarded, and second frame delay 52 to generate coefficients for frame m−1 from the audio bitstream for frame m+1. If coefficients for frame m are not discarded, first frame delay 51 sends the coefficients for frame m to multiplexer 49. Second frame delay 52 sends the coefficients for frame m−1 to FLC module 43.

If errors are not detected within frame m, error detection module 42 may enable multiplexer 49 to pass coefficients for frame m directly from first frame delay 51 to inverse transform unit 50 to be transformed into audio signal samples for frame m. If errors are detected within frame m, error detection module 42 discards all of the coefficients for frame m and enables multiplexer 49 to pass coefficient estimates for frame m from FLC module 43 to inverse transform unit 50 (76).

Core decoder 41 sends the coefficients $X_{m+1}(k)$ for frame m+1 to magnitude estimator 44 and second frame delay 52 sends the coefficients $X_{m-1}(k)$ for frame m−1 to magnitude estimator 44. Magnitude estimator 44 estimates magnitudes of coefficients for frame m based on the coefficients for frames m+1 and m−1 (78). For example, magnitude estimator 44 may implement the energy interpolation technique given in equation (1) to estimate coefficient magnitudes. Magnitude estimator 44 then sends the estimated coefficient magnitudes $\hat{X}_m(k)$ for frame m to component selection module 46.

Component selection module 46 differentiates between tonal components and noise components of frame m by sorting the estimated coefficient magnitudes for frame m. The coefficients with the largest magnitudes may be considered tonal components and the remaining coefficients may be considered noise components. The number of tonal components selected may be based on a predetermined number of signs to be transmitted. In other cases, the number of tonal component selected for frame m may vary based on the audio signal. Component selection module 46 then generates an estimated index subset $\hat{I}_m$ that identifies locations of the tonal components selected from the estimated coefficient magnitudes for frame m (80).

Component selection module 46 selects tonal components within frame m using the exact same operation as component selection module 36 within audio encoder 20, from which the audio bitstreams are received. Therefore, the same estimated index subset $\hat{I}_m$ that identifies locations of the tonal components selected from estimated coefficient magnitudes for frame m may be generated in both audio encoder 20 and audio decoder 40. Audio decoder 40 may then apply the subset of signs $S_m$ 28 for tonal components of frame m to the appropriate estimated coefficient magnitudes of frame m identified by the estimated index subset.

Component selection module 46 sends the estimated index subset for frame m to sign estimator 48. Sign estimator 48 also receives the subset of signs $S_m$ 28 for frame m transmitted with the audio bitstream 26 for frame m+1 from audio encoder 20. Sign estimator 48 then estimates signs for both tonal components and noise components for frame m. In the case of tonal components, sign estimator 48 estimates signs from the subset of signs $S_m$ 28 for frame m based on the estimated index subset (82). In the case of noise components, sign estimator 48 estimates signs from a random signal (84).

FLC module 43 then combines the magnitude estimates $\hat{X}_m(k)$ from magnitude estimator 44 and the sign estimates $S^*_m(k)$ from sign estimator 48 to estimate coefficients for frame m (86). FLC module 43 sends the coefficient estimates $\tilde{X}^*_m(k)$ to inverse transform unit 50, which transforms the coefficients estimates for frame m into estimated samples of the audio signal for frame m, $\tilde{x}_m[n]$ (88).

Figure 7:
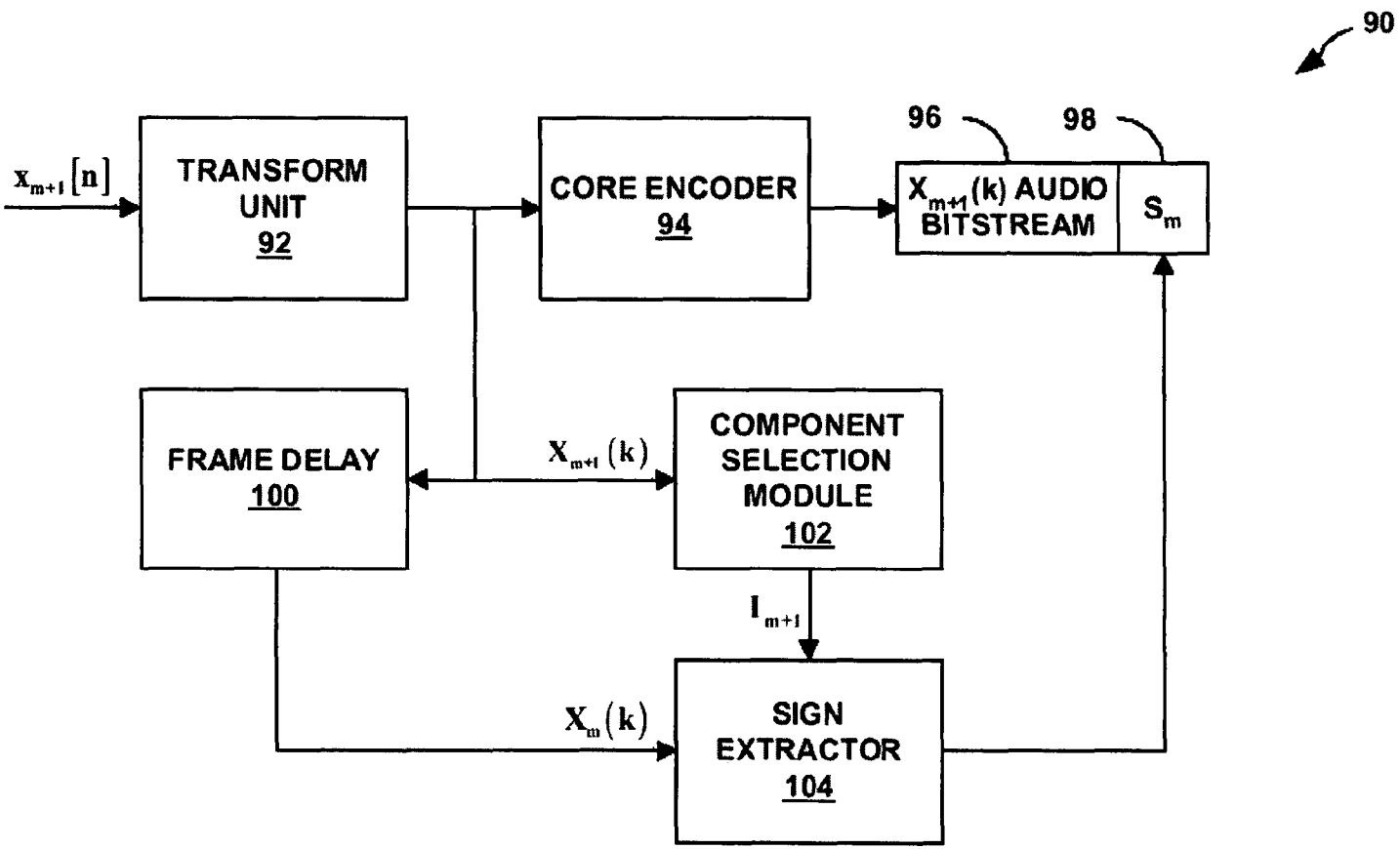
FIG. 7 is a block diagram illustrating another example audio encoder including a component selection module and a sign extractor that generates a subset of signs for a frame to be transmitted as side-information.

FIG. 7 is a block diagram illustrating another example audio encoder 90 including a component selection module 102 and a sign extractor 104 that generates a subset of signs for a frame to be transmitted as side-information. Audio encoder 90 may be substantially similar to audio codecs 6 and 10 within respective communication devices 3 and 4 from FIG. 1. As illustrated in FIG. 7, audio encoder 90 includes a transform unit 92, a core encoder 94, a frame delay 100, component selection module 102, and sign extractor 104. For purposes of illustration, audio encoder 90 will be described herein as conforming to the AAC standard in which frequency-domain data of a frame of an audio signal is represented by MDCT coefficients. In addition, transform unit 92 will be described as a modified discrete cosine transform unit.

In other embodiments, audio encoder 90 may conform to any of the audio coding standards listed above.

The techniques will be described herein as concealing a frame m of an audio signal. Frame m+1 represents the audio frame that immediately follows frame m of the audio signal. Similarly, frame m−1 represents the audio frame that immediately precedes frame m of the audio signal. In other embodiments, the encoder-assisted FLC techniques may utilize neighboring frames of frame m that do not immediate precede or follow frame m to conceal frame m.

Transform unit 92 receives samples of an audio signal $x_{m+1}[n]$ for frame m+1 and transforms the samples into coefficients $X_{m+1}(k)$. Core encoder 94 then encodes the coefficients into an audio bitstream 96 for frame m+1. Component selection module 102 uses coefficients $X_{m+1}(k)$ for frame m+1 and sign extractor 104 uses coefficients $X_m(k)$ for frame m to generate a subset of signs $S_m$ 98 for frame m. Sign extractor 104 attaches the subset of signs $S_m$ 98 to audio bitstream 96 for frame m+1 as side-information.

More specifically, transform unit 92 sends the coefficients $X_{m+1}(k)$ for frame m+1 to component selection module 102 and frame delay 100. Frame delay 100 generates coefficients $X_m(k)$ for frame m and sends the coefficients for frame m to sign extractor 104. Component selection module 102 differentiates between tonal components and noise components of frame m+1 by sorting the coefficient magnitudes for frame m+1. The coefficients with the largest magnitudes or most prominent spectral peaks may be considered tonal components and the remaining coefficients may be considered noise components.

The number of tonal components selected may be based on a predetermined number of signs to be transmitted. For example, ten of the coefficients with the highest magnitudes may be selected as tonal components of frame m+1. In other cases, component selection module 102 may select more or less than ten tonal components. In still other cases, the number of tonal component selected for frame m+1 may vary based on the audio signal. For example, if the audio signal includes a larger number of tonal components in frame m+1 than in other frames of the audio signal, component selection module 36 may select a larger number of tonal components from frame m+1 than from the other frames.

In other embodiments, component selection module 102 may select the tonal components from the coefficient magnitudes for frame m+1 using a variety of other schemes to differentiate between tonal components and noise components of frame m+1. For example, component selection module 102 may select a subset of coefficients based on some psychoacoustic principles. Audio encoder 90 may employ more accurate component differentiation schemes as the complexity level of audio encoder 90 allows.

Component selection module 102 then generates an index subset $I_{m+1}$ that identifies locations of the tonal components selected from the coefficient magnitudes for frame m+1. The tonal components are chosen as the coefficients for frame m+1 having the most prominent magnitudes. The coefficients for frame m+1 are available to an audio decoder when performing concealment of frame m. Therefore, the index subset is derived based on the coefficients magnitudes $X_{m+1}(k)$ for frame m+1. The index subset is given below:

$$I_{m+1} \cong \{k \mid |X_{m+1}(k)| > \mathrm{Thr}, 0 < k < M\}, \tag{6}$$

where M is the number of MDCT coefficients within frame m+1, Thr is a threshold determined such that $|I_{m+1}| = B_{m+1}$, and $B_{m+1}$ is the number of signs to be transmitted. For example, $B_{m+1}$ may be equal to 10 signs. In other embodiments, $B_{m+1}$ may be more or fewer than 10. In still other embodiments, $B_{m+1}$ may vary based on the audio signal of frame m.

Component selection module 102 sends the index subset for frame m+1 to sign extractor 104. Sign extractor 104 also receives the coefficients $X_m(k)$ for frame m from frame delay 100. It is assumed that an index subset for frame m would be approximately equal to the index subset for frame m+1. Sign extractor 104 then extracts signs from coefficients $X_m(k)$ for frame m identified by the index subset for frame m+1. For example, the index subset includes a predetermined number, e.g., 10, of coefficient indices that identify the tonal components selected from the coefficient magnitudes for frame m+1. Sign extractor 104 then extracts signs corresponding to the coefficients $X_m(k)$ for frame m with indices k equal to the indices within the index subset for frame m+1. Sign extractor 104 then attaches the subset of signs $S_m$ 98 extracted from the tonal components for frame m identified by the index subset for frame m+1 to the audio bitstream 96 for frame m+1.

Component selection module 102 selects tonal components within frame m+1 using the exact same operation as an audio decoder receiving transmissions from audio encoder 90. Therefore, the same index subset $I_{m+1}$ that identifies locations of the tonal components selected from coefficient magnitudes for frame m+1 may be generated in both audio encoder 90 and an audio decoder. The audio decoder may then apply the subset of signs $S_m$ 98 for tonal components of frame m to the appropriate estimated coefficient magnitudes of frame m identified by the index subset for frame m+1. In this way, the amount of side-information transmitted may be minimized as audio encoder 90 does not need to transmit the locations of the tonal components within frame m along with the subset of signs $S_m$ 98.

Figure 8:
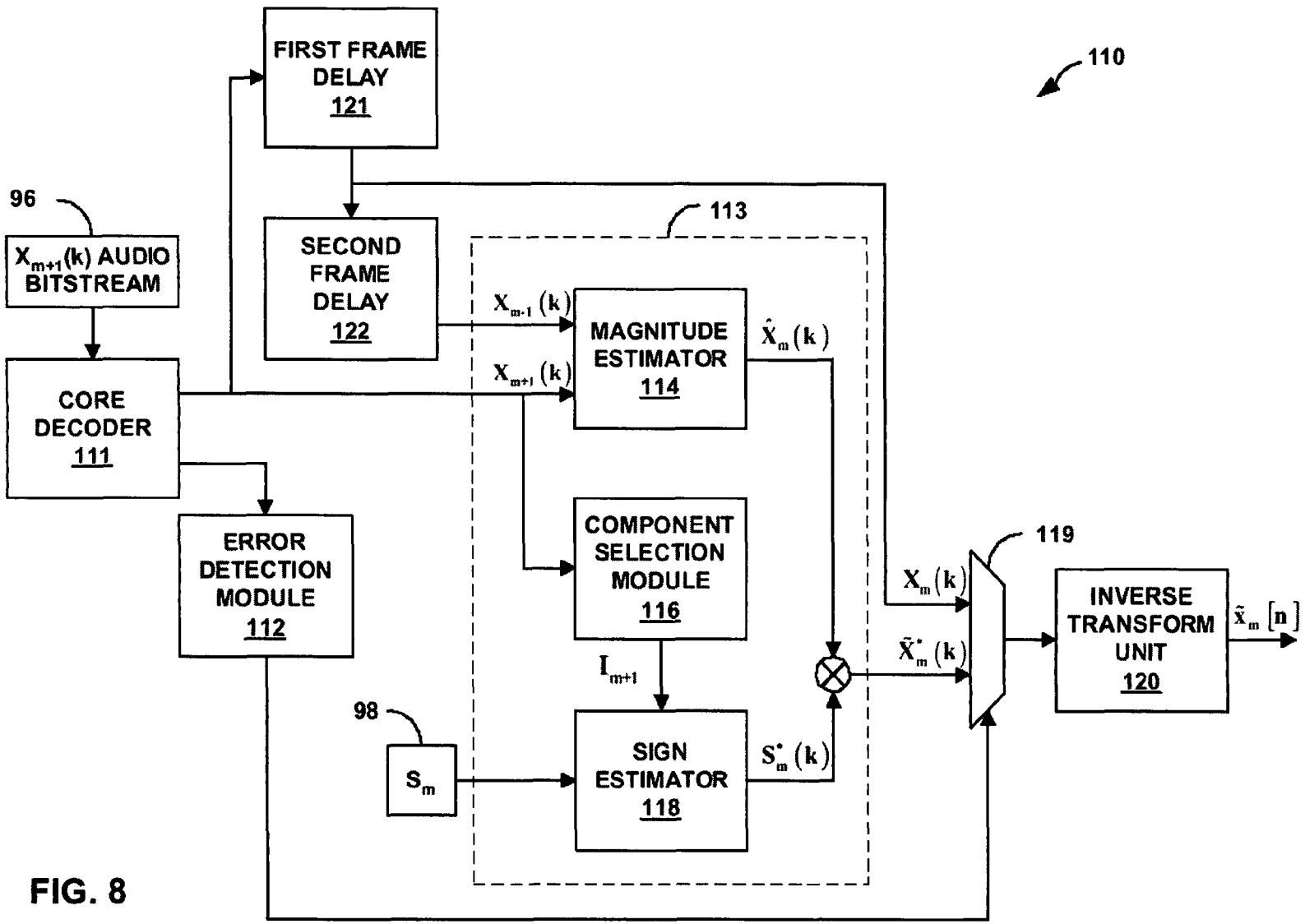
FIG. 8 is a block diagram illustrating another example audio decoder including a frame loss concealment module that utilizes a subset of signs for a frame received from an encoder as side-information.

FIG. 8 is a block diagram illustrating another example audio decoder 110 including a frame loss concealment module 113 that utilizes a subset of signs for a frame received from an encoder as side-information. Audio decoder 110 may be substantially similar to audio codecs 6 and 10 within respective communication devices 3 and 4 from FIG. 1. Audio decoder 110 may receive audio bitstreams from an audio encoder substantially similar to audio encoder 90 from FIG. 7. As illustrated in FIG. 8, audio decoder 110 includes a core decoder 111, an error detection module 112, FLC module 113, and an inverse transform unit 120.

For purposes of illustration, audio decoder 110 will be described herein as conforming to the AAC standard in which frequency-domain data of a frame of an audio signal is represented by MDCT coefficients. In addition, inverse transform unit 120 will be described as an inverse modified discrete cosine transform unit. In other embodiments, audio decoder 110 may conform to any of the audio coding standards listed above.

Core decoder 111 receives an audio bitstream for frame m including coefficients $X_m(k)$ and sends the audio bitstream for frame m to an error detection module 112. Error detection module 112 then performs error detection on the audio bitstream for frame m. Core decoder 111 subsequently receives audio bitstream 96 for frame m+1 including coefficients $X_{m+1}(k)$ and subset of signs $S_m$ 98 for frame m as side-information. Core decoder 111 uses first frame delay 121 to generate coefficients for frame m, if not discarded, and second frame delay 122 to generate coefficients for frame m−1 from the audio bitstream for frame m+1. If coefficients for frame m are not discarded, first frame delay 121 sends the coefficients for frame m to multiplexer 119. Second frame delay 122 sends the coefficients for frame m−1 to FLC module 113.

If errors are not detected within frame m, error detection module 112 may enable multiplexer 119 to pass coefficients $X_m(k)$ for frame m directly from first frame delay 121 to inverse transform unit 120 to be transformed into audio signal samples for frame m.

If errors are detected within frame m, error detection module 112 discards all of the coefficients for frame m and enables multiplexer 119 to pass coefficient estimates $\tilde{X}^*_m(k)$ for frame m from FLC module 113 to inverse transform unit 120. FLC module 113 receives coefficients $X_{m+1}(k)$ for frame m+1 from core decoder 111 and receives coefficients $X_{m-1}(k)$ for frame m−1 from second frame delay 122. FLC module 113 uses coefficients for frame m+1 and m−1 to estimate magnitudes of coefficients for frame m. In addition, FLC module 113 uses the subset of signs $S_m$ 98 for frame m transmitted with audio bitstream 96 for frame m+1 from audio encoder 90 to estimate signs of coefficients for frame m. FLC module 113 then combines the magnitude estimates and sign estimates to estimate coefficients for frame m. FLC module 113 sends the coefficient estimates $\tilde{X}^*_m(k)$ to inverse transform unit 120, which transforms the coefficient estimates for frame m into estimated samples of the audio signal for frame m, $\tilde{x}_m[n]$.

FLC module 113 includes a magnitude estimator 114, a component selection module 116, and a sign estimator 118. Core decoder 111 sends the coefficients $X_{m+1}(k)$ for frame m+1 to magnitude estimator 114 and second frame delay 122 sends the coefficients $X_{m-1}(k)$ for frame m−1 to magnitude estimator 114. Magnitude estimator 114 estimates magnitudes of coefficients for frame m based on the coefficients for frames m+1 and m−1. Magnitude estimator 114 may implement one of a variety of interpolation techniques to estimate coefficient magnitudes for frame m. For example, magnitude estimator 114 may implement energy interpolation based on the energy of the previous frame coefficient $X_{m-1}(k)$ for frame m−1 and the next frame coefficient $X_{m+1}(k)$ for frame m+1. The coefficient magnitude estimates $\hat{X}_m(k)$ is given in equation (1). In other embodiments, the encoder-assisted FLC techniques may utilize neighboring frames of frame m that do not immediate precede or follow frame m to estimate magnitudes of coefficients for frame m.

Component selection module 116 receives coefficients $X_{m+1}(k)$ for frame m+1 and differentiates between tonal components and noise components of frame m+1 by sorting magnitudes of the coefficients for frame m+1. The coefficients with the largest magnitudes or most prominent spectral peaks may be considered tonal components and the remaining coefficients may be considered noise components. The number of tonal components selected may be based on a predetermined number of signs to be transmitted. In other cases, the number of tonal component selected for frame m+1 may vary based on the audio signal. Component selection module 116 then generates an index subset $I_{m+1}$ that identifies locations of the tonal components selected from the coefficient magnitudes for frame m+1. The index subset for frame m+1 is given above in equation (6). It is assumed that an index subset for frame m would be approximately equal to the index subset of frame m+1.

Component selection module 116 selects tonal components within frame m+1 using the exact same operation as component selection module 102 within audio encoder 90, from which the audio bitstreams are received. Therefore, the same index subset $I_{m+1}$ that identifies locations of the tonal components selected from coefficient magnitudes for frame m+1 may be generated in both audio encoder 90 and audio decoder 110. Audio decoder 110 may then apply the subset of signs $S_m$ 98 for tonal components of frame m to the appropriate estimated coefficient magnitudes of frame m identified by the index subset for frame m+1.

Component selection module 116 sends the index subset for frame m+1 to sign estimator 118. Sign estimator 118 also receives the subset of signs $S_m$ 98 for frame m transmitted with the audio bitstream 96 for frame m+1 from encoder 90. Sign estimator 118 then estimates signs for both tonal components and noise components for frame m.

In the case of noise components, sign estimator 118 estimates signs from a random signal. In the case of tonal components, sign estimator 118 estimates signs from the subset of signs $S_m$ 98 based on the index subset for frame m+1. For example, the index subset includes a predetermined number, e.g., 10, of coefficient indices that identify the tonal components selected from the coefficient magnitudes for frame m+1. Sign estimator 118 then estimates signs for tonal components of frame m as the subset of signs $S_m$ 98 with indices k equal to the indices within the index subset for frame m+1. The sign estimation is given below:

$$S^*_m(k) = \begin{cases} sgn(X_m(k)), \text{ for } k \in I_{m+1} \\ S_m(k), \text{ for } k \notin I_{m+1}, \end{cases} \tag{7}$$

where sgn( ) denotes the sign function, $I_{m+1}$ is the index subset of the coefficients corresponding to the selected tonal components, and $S_m(k)$ is a random variable with sample space {−1, 1}.

As described above, in order to estimate signs for the tonal components of frame, audio decoder 110 needs to know the location of the tonal components within frame m as well as the corresponding signs of the original tonal components of frame m. A simple way for audio decoder 110 to receive this information would be to explicitly transmit both parameters from audio encoder 90 to audio decoder 110 at the expense of increased bit-rate. In the illustrated embodiment, index subset $I_{m+1}$ is self-derived at both audio encoder 90 and audio decoder 110 using the exact same derivation process, whereas the signs for the tonal components of frame m indexed by index subset $I_{m+1}$ for frame m+1 are transmitted from audio encoder 90 as side-information.

FLC module 113 then combines the magnitude estimates $\hat{X}_m(k)$ from magnitude estimator 114 and the sign estimates $S^*_m(k)$ from sign estimator 118 to estimate coefficients for frame m. The coefficients estimates $\tilde{X}_m(k)$ for frame m are given in equation (5). FLC module 113 then sends the coefficient estimates to inverse transform unit 120, which transforms the coefficient estimates for frame m into estimated samples of the audio signal for frame m, $\tilde{x}_m[n]$.

Figure 9:
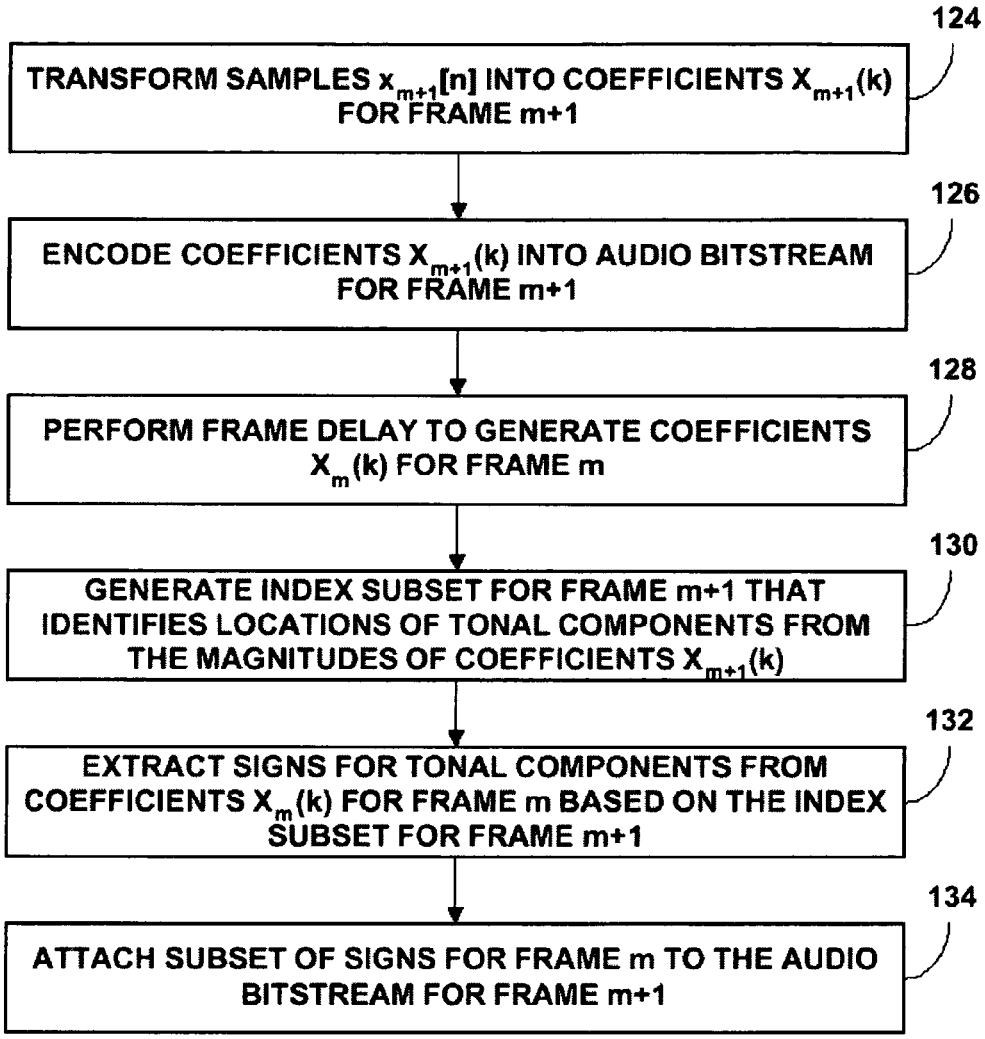
FIG. 9 is a flowchart illustrating another exemplary operation of encoding an audio bitstream and generating a subset of signs for a frame to be transmitted with the audio bitstream as side-information.

FIG. 9 is a flowchart illustrating another exemplary operation of encoding an audio bitstream and generating a subset of signs for a frame to be transmitted with the audio bitstream as side-information. The operation will be described herein in reference to audio encoder 90 from FIG. 7.

Transform unit 92 receives samples of an audio signal $x_{m+1}[n]$ for frame m+1 and transforms the samples into coefficients $X_{m+1}(k)$ for frame m+1 (124). Core encoder 94 then encodes the coefficients into an audio bitstream 96 for frame m+1 (126). Transform unit 92 sends the coefficients $X_{m+1}(k)$ for frame m+1 to component selection module 102 and frame delay 100. Frame delay 100 performs a frame delay and generates coefficients $X_m(k)$ for frame m (128). Frame delay 30 then sends the coefficients for frame m to sign extractor 104.

Component selection module 102 differentiates between tonal components and noise components of frame m+1 by sorting the coefficient magnitudes for frame m+1. The coefficients with the largest magnitudes may be considered tonal components and the remaining coefficients may be considered noise components. The number of tonal components selected may be based on a predetermined number of signs to be transmitted. In other cases, the number of tonal component selected for frame m+1 may vary based on the audio signal. Component selection module 102 then generates an index subset $I_{m+1}$ that identifies the tonal components selected from the coefficient magnitudes for frame m+1 (130).

Component selection module 102 sends the index subset for frame m+1 to sign extractor 104. Sign extractor 104 also receives the coefficients $X_m(k)$ for frame m from frame delay 100. It is assumed that an index subset for frame m would be approximately equal to the index subset for frame m+1. Sign extractor 104 then extracts signs from coefficients $X_m(k)$ for frame m identified by the index subset for frame m+1 (132). Sign extractor 104 then attaches the subset of signs $S_m$ 98 extracted from the tonal components for frame m identified by the index subset for frame m+1 to the audio bitstream 96 for frame m+1 (134).

Figure 10:
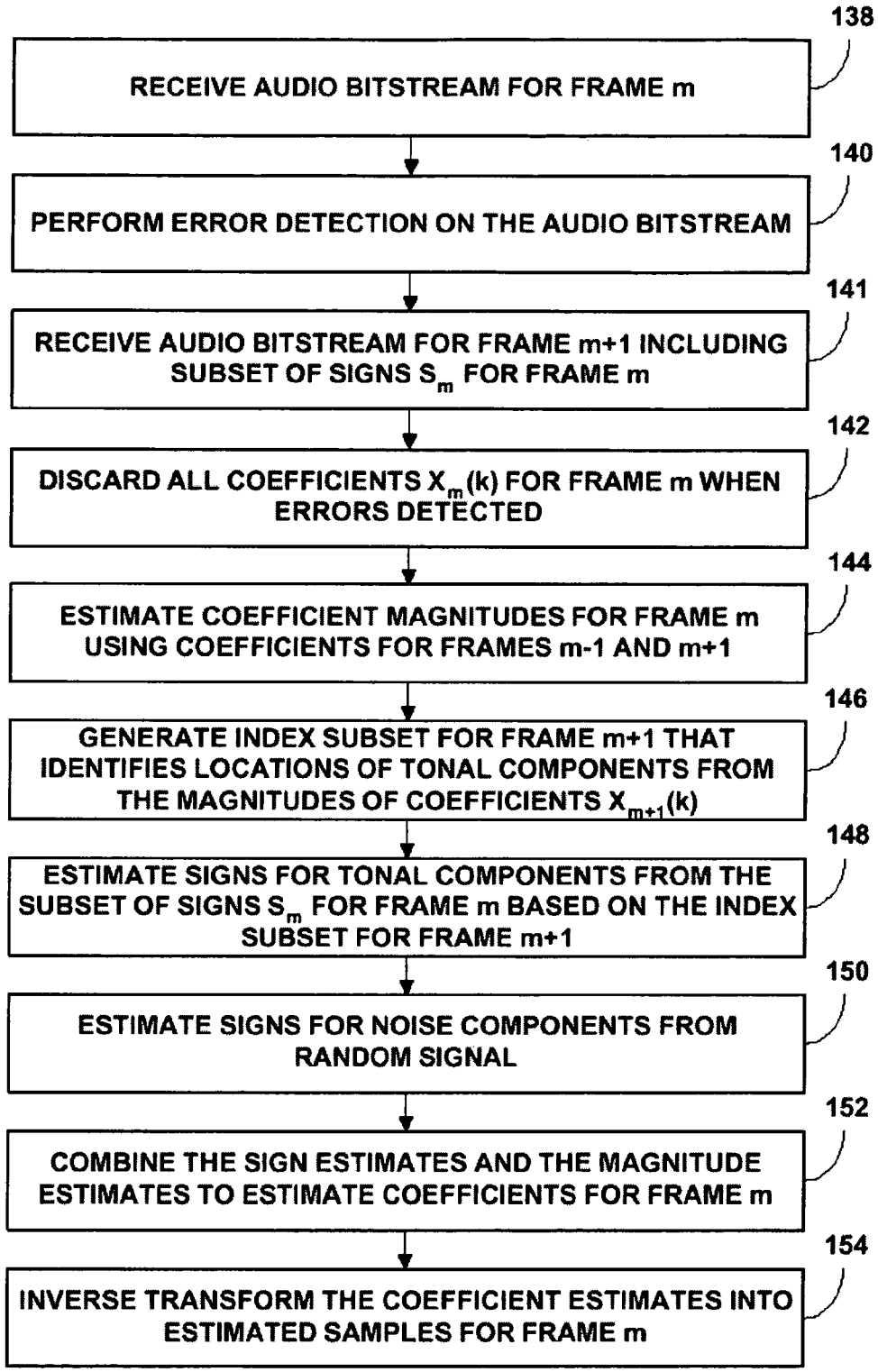
FIG. 10 is a flowchart illustrating another exemplary operation of decoding an audio bitstream and performing frame loss concealment using a subset of signs for a frame received from an encoder as side-information.

FIG. 10 is a flowchart illustrating another exemplary operation of decoding an audio bitstream and performing frame loss concealment using a subset of signs for a frame received from an encoder as side-information. The operation will be described herein in reference to audio decoder 110 from FIG. 8.

Core decoder 111 receives an audio bitstream for frame m including coefficients $X_m(k)$ (138). Error detection module 112 then performs error detection on the audio bitstream for frame m (140). Core decoder 111 subsequently receives audio bitstream 96 for frame m+1 including coefficients $X_{m+1}(k)$ and subset of signs $S_m$ 98 for frame m as side-information (141). Core decoder 111 uses first frame delay 121 to generate coefficients for frame m, if not discarded, and second frame delay 122 to generate coefficients for frame m−1 from the audio bitstream for frame m+1. If coefficients for frame m are not discarded, first frame delay 121 sends the coefficients for frame m to multiplexer 119. Second frame delay 122 sends the coefficients for frame m−1 to FLC module 113.

If errors are not detected within frame m, error detection module 112 may enable multiplexer 119 to pass coefficients for frame m directly from first frame delay 121 to inverse transform unit 120 to be transformed into audio signal samples for frame m. If errors are detected within frame m, error detection module 112 discards all of the coefficients for frame m and enables multiplexer 119 to pass coefficient estimates for frame m from FLC module 113 to inverse transform unit 120 (142).

Core decoder 111 sends the coefficients $X_{m+1}(k)$ for frame m+1 to magnitude estimator 114 and second delay frame 122 sends the coefficients $X_{m-1}(k)$ for frame m−1 to magnitude estimator 114. Magnitude estimator 114 estimates magnitudes of coefficients for frame m based on the coefficients for frames m+1 and m−1 (144). For example, magnitude estimator 44 may implement the energy interpolation technique given in equation (1) to estimate coefficient magnitudes.

Component selection module 116 receives coefficients $X_{m+1}(k)$ for frame m+1 and differentiates between tonal components and noise components of frame m+1 by sorting magnitudes of the coefficients for frame m+1. The coefficients with the largest magnitudes may be considered tonal components and the remaining coefficients may be considered noise components. The number of tonal components selected may be based on a predetermined number of signs to be transmitted. In other cases, the number of tonal component selected for frame m+1 may vary based on the audio signal. Component selection module 116 then generates an index subset $I_{m+1}$ that identifies locations of the tonal components selected from the coefficient magnitudes for frame m+1 (146). It is assumed that an index subset for frame m would be approximately equal to the index subset of frame m+1.

Component selection module 116 selects tonal components within frame m+1 using the exact same operation as component selection module 102 within audio encoder 90, from which the audio bitstreams are received. Therefore, the same index subset $I_{m+1}$ that identifies locations of the tonal components selected from coefficient magnitudes for frame m+1 may be generated in both audio encoder 90 and audio decoder 110. Audio decoder 110 may then apply the subset of signs $S_m$ 98 for tonal components of frame m to the appropriate estimated coefficient magnitudes of frame m identified by the index subset for frame m+1.

Component selection module 116 sends the index subset for frame m+1 to sign estimator 118. Sign estimator 118 also receives the subset of signs $S_m$ 98 for frame m transmitted with the audio bitstream 96 for frame m+1 from encoder 90. Sign estimator 118 estimates signs for tonal components of frame m from the subset of signs $S_m$ 98 based on the index subset for frame m+1 (148). Sign estimator 118 estimates signs for noise components from a random signal (150).

FLC module 113 then combines the magnitude estimates $\hat{X}_m(k)$ from magnitude estimator 114 and the sign estimates $S^*_m(k)$ from sign estimator 118 to estimate coefficients for frame m (152). FLC module 113 sends the coefficient estimates $\tilde{X}^*_m(k)$ to inverse transform unit 120, which transforms the coefficients estimates for frame m into estimated samples of the audio signal for frame m, $\tilde{x}_m[n]$ (154).

Figure 11:
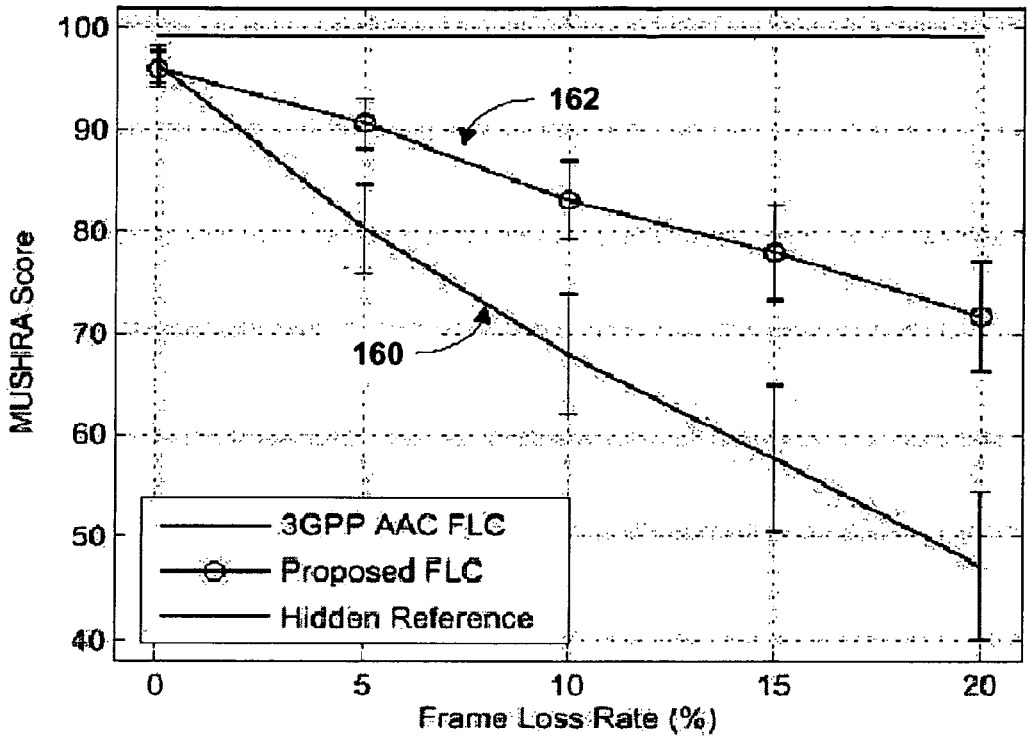
FIG. 11 is a plot illustrating a quality comparison between frame loss rates of a conventional frame loss concealment technique and frame loss rates of the encoder-assisted frame loss concealment technique described herein.

FIG. 11 is a plot illustrating a quality comparison between frame loss rates of a conventional FLC technique 160 and frame loss rates of the encoder-assisted FLC technique 162 described herein. The comparisons are performed between the two FLC methods under frame loss rates (FLRs) of 0%, 5%, 10%, 15%, and 20%. A number of mono audio sequences sampled from CD were encoded at the bitrate of 48 kbps, and the encoded frames were randomly dropped at the specified rates with restriction to single frame loss.

For the encoder-assisted FLC technique described herein, the number of signs the encoder transmitted as side information was fixed for all frames and restricted to 10 bits/frame, which is equivalent to the bitrate of 0.43 kbps. Two different bitstreams were generated: (i) 48 kbps AAC bitstream for the convention FLC technique and (ii) 47.57 kbps AAC bitstream including sign information at the bitrate of 0.43 kbps for the encoder-assisted FLC technique. For subjective evaluation of the concealed audio quality, various genres of polyphonic audio sequences with 44.1 kHz sampling rate were selected, and the decoder reconstructions by both methods under various FLRs were compared. The multi-stimulus hidden reference with anchor (MUSHRA) test was employed and performed by eleven listeners.

From FIG. 11, it can be seen that the encoder-assisted FLC technique 162 improves audio decoder reconstruction quality at all FLRs. For example, the encoder-assisted FLC technique maintains reconstruction quality that is better than 80 point MUSHRA score at moderate (5% and 10%) FLR. Furthermore, the reconstruction quality of the encoder-assisted FLC technique 162 at 15% FLR is statistically equivalent to that of the conventional FLC technique 160 at 5% FLR, demonstrating the enhanced error-resilience offered by the encoder-assisted FLC technique.

A number of embodiments have been described. However, various modifications to these embodiments are possible, and the principles presented herein may be applied to other embodiments as well. Methods as described herein may be implemented in hardware, software, and/or firmware. The various tasks of such methods may be implemented as sets of instructions executable by one or more arrays of logic elements, such as microprocessors, embedded controllers, or IP cores. In one example, one or more such tasks are arranged for execution within a mobile station modem chip or chipset that is configured to control operations of various devices of a personal communications device such as a cellular telephone.

The techniques described in this disclosure may be implemented within a general purpose microprocessor, digital signal processor (DSP), application specific integrated circuit (ASIC), field programmable gate array (FPGA), or other equivalent logic devices. If implemented in software, the techniques may be embodied as instructions on a computer-readable medium such as random access memory (RAM), read-only memory (ROM), non-volatile random access memory (NVRAM), electrically erasable programmable read-only memory (EEPROM), FLASH memory, or the like. The instructions cause one or more processors to perform certain aspects of the functionality described in this disclosure.

As further examples, an embodiment may be implemented in part or in whole as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a microprocessor or other digital signal processing unit. The data storage medium may be an array of storage elements such as semiconductor memory (which may include without limitation dynamic or static RAM, ROM, and/or flash RAM) or ferroelectric, ovonic, polymeric, or phase-change memory; or a disk medium such as a magnetic or optical disk.

In this disclosure, various techniques have been described for encoder-assisted frame loss concealment in a decoder that accurately conceal a discarded frame of an audio signal based on neighboring frames and side-information transmitted with audio bitstreams from an encoder. The encoder-assisted FLC techniques may also accurately conceal multiple discarded frames of an audio signal based on neighboring frames at the expense of additional side-information transmitted from an encoder. The encoder-assisted FLC techniques include estimating magnitudes of frequency-domain data for the frame based on frequency-domain data of neighboring frames, and estimating signs of the frequency-domain data based on a subset of signs transmitted from the encoder as side-information.

Frequency-domain data for a frame of an audio signal includes tonal components and noise components. Signs estimated from a random signal may be substantially accurate for the noise components of the frequency-domain data. However, to achieve highly accurate sign estimation for the tonal components, the encoder transmits signs for the tonal components of the frequency-domain data as side-information. In order to minimize the amount of the side-information transmitted to the decoder, the encoder does not transmit locations of the tonal components within the frame. Instead, both the encoder and the decoder self-derive the locations of the tonal components using the same operation. In this way, the encoder-assisted FLC techniques achieve significant improvement of frame concealment quality at the decoder with a minimal amount of side-information transmitted from the encoder.

Although the encoder-assisted FLC techniques are primarily described herein in reference multimedia applications that utilize the AAC standard in which frequency-domain data of a frame of an audio signal is represented by MDCT coefficients. The techniques may be applied to multimedia application that use any of a variety of audio coding standards. For example, standards according to the MPEG, the WMA standard, standards by Dolby Laboratories, Inc, the MP3 standard, and successors to the MP3 standard. These and other embodiments are within the scope of the following claims.

The invention claimed is:

1. A method of concealing a frame of an audio signal comprising:

receiving the frame at a decoder, the frame including frequency-domain data of the audio signal;

the decoder detecting one or more errors in the frame and discarding the frequency-domain data as a result of detecting the errors;

the decoder estimating magnitudes of replacement frequency-domain data for the frame based on frequency-domain data included in neighboring frames of the frame;

the decoder estimating signs of the replacement frequency-domain data for the frame based on a subset of signs for the frame transmitted from an encoder as side-information of a neighboring frame of the frame; and the decoder combining the magnitude estimates and the sign estimates to estimate the replacement frequency-domain data for the frame.

2. The method of claim 1, further comprising:

receiving an audio bitstream for the frame including frequency-domain data from the encoder; and receiving the side-information for the frame with an audio bitstream for a neighboring frame from the encoder.

3. The method of claim 1, further comprising:

performing error detection on an audio bitstream for the frame transmitted from the encoder; and discarding frequency-domain data for the frame when one or more errors are detected.

4. The method of claim 1, wherein estimating magnitudes of the replacement frequency-domain data for the frame comprises performing energy interpolation based on the energy of a preceding frame of the frame and a subsequent frame of the frame.

5. The method of claim 1, wherein estimating signs of the replacement frequency-domain data for the frame comprises:

estimating signs for noise components of the replacement frequency-domain data for the frame from a random signal; and estimating signs for tonal components of the replacement frequency-domain data for the frame based on the subset of signs for the frame transmitted from the encoder as the side-information.

6. The method of claim 1, wherein estimating signs of the replacement frequency-domain data for the frame comprises:

selecting tonal components of the frequency-domain data for the frame;

generating an index subset that identifies locations of the tonal components within the frame; and estimating signs for the tonal components from the subset of signs for the frame based on the index subset.

7. The method of claim 6, wherein selecting tonal components comprises:

sorting the frequency-domain data in order of magnitudes; and selecting a predetermined number of the frequency-domain data with the highest magnitudes as the tonal components.

8. The method of claim 1, wherein estimating signs of the replacement frequency-domain data for the frame comprises:

selecting tonal components from the magnitude estimates of the frequency-domain data for the frame;

generating an estimated index subset that identifies locations of the tonal components selected from the magnitude estimates of the frequency-domain data for the frame; and estimating signs for the tonal components from the subset of signs for the frame based on the estimated index subset for the frame.

9. The method of claim 1, wherein estimating signs of the replacement frequency-domain data for the frame comprises:

selecting tonal components from magnitudes of frequency-domain data for a neighboring frame of the frame;

generating an index subset that identifies locations of the tonal components selected from the magnitudes of the frequency-domain data for the neighboring frame; and estimating signs for the tonal components from the subset of signs for the frame based on the index subset for the neighboring frame.

10. The method of claim 1, further comprising:

transmitting an audio bitstream for the frame including frequency-domain data to a decoder; and transmitting the side-information for the frame with an audio bitstream for a neighboring frame to a decoder.

11. The method of claim 10, wherein transmitting the side-information comprises:

extracting the subset of signs from the frequency-domain data for the frame; and attaching the subset of signs to the audio bitstream for the neighboring frame as the side-information.

12. The method of claim 11, wherein extracting the subset of signs for the frame comprises:

selecting tonal components of the frequency-domain data for the frame;

generating an index subset that identifies locations of the tonal components within the frame; and extracting the subset of signs for the tonal components from the frequency-domain data for the frame based on the index subset.

13. The method of claim 12, wherein selecting tonal components comprises:

sorting the frequency-domain data in order of magnitudes; and selecting a predetermined number of the frequency-domain data with the highest magnitudes as the tonal components.

14. The method of claim 11, wherein extracting the subset of signs for the frame comprises:

estimating magnitudes of the frequency-domain data for the frame based on neighboring frames of the frame;

selecting tonal components from the frequency-domain data magnitude estimates for the frame;

generating an estimated index subset that identifies locations of the tonal components selected from the frequency-domain data magnitude estimates for the frame; and extracting the subset of signs for the tonal components from the frequency-domain data for the frame based on the estimated index subset for the frame.

15. The method of claim 11, wherein extracting the subset of signs for the frame comprises:

selecting tonal components from frequency-domain data magnitudes for the neighboring frame;

generating an index subset that identifies locations of the tonal components selected from the frequency-domain data magnitudes for the neighboring frame; and extracting the subset of signs for the tonal components from the frequency-domain data for the frame based on the index subset for the neighboring frame.

16. The method of claim 1, further comprising:

encoding a time-domain audio signal for the frame into frequency-domain data for the frame with a transform unit included in the encoder; and decoding the replacement frequency-domain data for the frame into estimated time-domain data for the frame with an inverse transform unit included in a decoder.

17. The method of claim 1, wherein the side-information comprises a subset of signs for tonal components of frequency-domain data for the frame, the method further comprising:

generating an index subset that identifies locations of the tonal components within the frame with the encoder;

extracting the subset of signs for the tonal components from the frequency-domain data for the frame based on the index subset with the encoder;

transmitting the subset of signs for the tonal components as the side-information to a decoder;

generating an index subset that identifies locations of the tonal components within the frame with the decoder using the same process as the encoder; and estimating signs for the tonal components from the subset of signs based on the index subset.

18. A non-transitory computer-readable medium comprising instructions for concealing a frame of an audio signal that cause a programmable processor to:

receive the frame, the frame including frequency-domain data of the audio signal;

detect one or more errors in the frame;

discard the frequency-domain data as a result of detecting the errors;

estimate magnitudes of replacement frequency-domain data for the frame based on frequency-domain data included in neighboring frames of the frame;

estimate signs of the replacement frequency-domain data for the frame based on a subset of signs for the frame transmitted from an encoder as side-information of a neighboring frame of the frame; and combine the magnitude estimates and the sign estimates to estimate the replacement frequency-domain data for the frame.

19. The computer-readable medium of claim 18, wherein the instructions cause the programmable processor to:

estimate signs for noise components of the replacement frequency-domain data for the frame from a random signal; and estimate signs for tonal components of the replacement frequency-domain data for the frame based on the subset of signs for the frame transmitted from the encoder as the side-information.

20. The computer-readable medium of claim 18, wherein the instructions cause the programmable processor to:

sort the frequency-domain data for the frame in order of magnitudes;

select a predetermined number of the frequency-domain data with the highest magnitudes as tonal components of the frequency-domain data for the frame;

generate an index subset that identifies locations of the tonal components within the frame; and estimate signs for the tonal components from the subset of signs for the frame based on the index subset.

21. The computer-readable medium of claim 18, further comprising instructions that cause the programmable processor to:

extract the subset of signs from the frequency-domain data for the frame;

attach the subset of signs to an audio bitstream for a neighboring frame as the side-information; and transmit the side-information for the frame with the audio bitstream for the neighboring frame to a decoder.

22. The computer-readable medium of claim 21, wherein the instructions cause the programmable processor to:

sort the frequency-domain data for the frame in order of magnitudes;

select a predetermined number of the frequency-domain data with the highest magnitudes as tonal components of the frequency-domain data for the frame;

generate an index subset that identifies locations of the tonal components within the frame; and extract the subset of signs for the tonal components from the frequency-domain data for the frame based on the index subset.

23. A system for concealing a frame containing frequency-domain data of an audio signal comprising:

an encoder that transmits a subset of signs for the frame as side-information of a neighboring frame of the frame; and a decoder including a frame loss concealment (FLC) module that receives the side-information for the frame from the encoder, and an error detection module that detects one or more errors in the frame and discards the frequency-domain data as a result of detecting the errors, wherein the FLC module estimates magnitudes of replacement frequency-domain data for the frame based on frequency-domain data of neighboring frames of the frame, estimates signs of the replacement frequency-domain data for the frame based on the subset of signs received as side-information, and combines the magnitude estimates and the sign estimates to estimate the replacement frequency-domain data for the frame.

24. The system of claim 23, wherein the error detection module performs error detection on an audio bitstream for the frame transmitted from the encoder.

25. The system of claim 23, wherein the FLC module includes a magnitude estimator that performs energy interpolation based on the energy of a preceding frame of the frame and a subsequent frame of the frame to estimate the magnitudes of the replacement frequency-domain data for the frame.

26. The system of claim 23, wherein the FLC module includes a sign estimator that:

estimates signs for noise components of the replacement frequency-domain data for the frame from a random signal; and estimates signs for tonal components of the replacement frequency-domain data for the frame based on the subset of signs for the frame transmitted from the encoder as the side-information.

27. The system of claim 23, wherein the FLC module includes a component selection module that sorts the frequency-domain data for the frame in order of magnitudes, selects a predetermined number of the frequency-domain data with the highest magnitudes as tonal components of the frequency-domain data for the frame, and generates an index subset that identifies locations of the tonal components within the frame; and wherein the sign estimator estimates signs for the tonal components from the subset of signs for the frame based on the index subset.

28. The system of claim 23, wherein the encoder includes a sign extractor that extracts the subset of signs from the frequency-domain data for the frame, and attaches the subset of signs to an audio bitstream for a neighboring frame as the side-information, wherein the encoder transmits the side-information for the frame with the audio bitstream for the neighboring frame to the decoder.

29. The system of claim 28, wherein the encoder includes a component selection module that sorts the frequency-domain data for the frame in order of magnitudes, selects a predetermined number of the frequency-domain data with the highest magnitudes as tonal components of the frequency-domain data for the frame, and generates an index subset that identifies locations of the tonal components within the frame; and wherein the sign extractor extracts the subset of signs for the tonal components from the frequency-domain data for the frame based on the index subset.

30. The system of claim 23, wherein frequency-domain data for the frame is represented by modified discrete cosine transform (MDCT) coefficients.

31. The system of claim 23, wherein the encoder includes a transform unit that encodes a time-domain audio signal for the frame into frequency-domain data for the frame; and wherein the decoder includes an inverse transform unit that decodes the replacement frequency-domain data for the frame into replacement time-domain data for the frame.

32. The system of claim 31, wherein the transform unit included in the encoder comprises a modified discrete cosine transform unit, and wherein the inverse transform unit included in the decoder comprises an inverse modified discrete cosine transform unit.

33. The system of claim 23, wherein the side-information comprises a subset of signs for tonal components of frequency-domain data for the frame, wherein the encoder generates an index subset that identifies locations of the tonal components within the frame with the encoder, extracts the subset of signs for the tonal components from the frequency-domain data for the frame based on the index subset with the encoder, and transmits the subset of signs for the tonal components as the side-information to the decoder; and wherein the decoder generates an index subset that identifies locations of the tonal components within the frame with the decoder using the same process as the encoder, and estimates signs for the tonal components from the subset of signs based on the index subset.

34. An encoder comprising:

a component selection module that selects components of frequency-domain data for a frame of an audio signal; and a sign extractor that extracts a subset of signs for the selected components from the frequency-domain data for the frame, wherein the encoder transmits the subset of signs for the frame to a decoder as side-information of a neighboring frame of the frame.

35. The encoder of claim 34, wherein the encoder transmits an audio bitstream for the frame including frequency-domain data to the decoder and transmits the side-information for the frame with an audio bitstream for a neighboring frame to the decoder, wherein the sign extractor attaches the side-information for the frame to the audio bitstream for the neighboring frame.

36. The encoder of claim 34, wherein the component selection module generates an index subset that identifies locations of the components within the frame.

37. The encoder of claim 34, wherein the selected components comprise tonal components of the frequency-domain data for the frame, wherein the component selection module sorts the frequency-domain data for the frame in order of magnitudes, and selects a predetermined number of the frequency-domain data with the highest magnitudes as the tonal components.

38. The encoder of claim 34, further comprising a FLC module including:

a magnitude estimator that estimates magnitudes of the frequency-domain data for the frame based on neighboring frames of the frame;

the component selection module that selects tonal components from the frequency-domain data magnitude estimates for the frame, and generates an estimated index subset that identifies locations of the tonal components selected from the frequency-domain data magnitude estimates for the frame; and the sign extractor that extracts the subset of signs for the tonal components from the frequency-domain data for the frame based on the estimated index subset for the frame.

39. The encoder of claim 34, wherein the component selection module selects tonal components from frequency-domain data magnitudes for the neighboring frame, and generates an index subset that identifies locations of the tonal components selected from the frequency-domain data magnitudes for the neighboring frame; and wherein the sign extractor extracts the subset of signs for the tonal components from the frequency-domain data for the frame based on the index subset for the neighboring frame.

40. A decoder comprising:

an error detection module that detects one or more errors in a frame of an audio signal and discards frequency-domain data of the frame as a result of detecting the errors; and a frame loss concealment (FLC) module including:

a magnitude estimator that estimates magnitudes of replacement frequency-domain data for the frame based on neighboring frames of the frame; and a sign estimator that estimates signs of the replacement frequency-domain data for the frame based on a subset of signs for the frame transmitted from an encoder as side-information of a neighboring frame of the frame, wherein the decoder combines the magnitude estimates and the sign estimates to estimate the replacement frequency-domain data for the frame.

41. The decoder of claim 40, wherein the decoder receives an audio bitstream for the frame including frequency-domain data from the encoder, and receives the side-information for the frame with an audio bitstream for a neighboring frame from the encoder.

42. The decoder of claim 40, wherein the error detection module performs error detection on an audio bitstream for the frame transmitted from the encoder.

43. The decoder of claim 40, wherein the FLC module includes a magnitude estimator that performs energy interpolation based on the energy of a preceding frame of the frame and a subsequent frame of the frame to estimate the magnitudes of the replacement frequency-domain data for the frame.

44. The decoder of claim 40, wherein the sign estimator estimates signs for noise components of the replacement frequency-domain data for the frame from a random signal, and estimates signs for tonal components of the replacement frequency-domain data for the frame based on the subset of signs for the frame transmitted from the encoder as the side-information.

45. The decoder of claim 40, wherein the FLC module includes a component selection module that selects tonal components of the frequency-domain data for the frame, and generates an index subset that identifies locations of the tonal components within the frame; and wherein the sign estimator estimates signs for the tonal components from the subset of signs for the frame based on the index subset.

46. The decoder of claim 45, wherein the component selection module sorts the frequency-domain data in order of magnitudes, and selects a predetermined number of the frequency-domain data with the highest magnitudes as the tonal components.

47. The decoder of claim 40, wherein the FLC module includes a component selection module that selects tonal components from the magnitude estimates of the frequency-domain data for the frame, and generates an estimated index subset that identifies locations of the tonal components selected from the magnitude estimates of the frequency-domain data for the frame; and wherein the sign estimator estimates signs for the tonal components from the subset of signs for the frame based on the estimated index subset for the frame.

48. The decoder of claim 40, wherein the FLC module includes a component selection module that selects tonal components from magnitudes of frequency-domain data for a neighboring frame of the frame, and generates an index subset that identifies locations of the tonal components selected from the magnitudes of the frequency-domain data for the neighboring frame; and wherein the sign estimator estimates signs for the tonal components from the subset of signs for the frame based on the index subset for the neighboring frame.

49. An apparatus for concealing a frame of an audio signal comprising:

means for receiving the frame which includes frequency-domain data of the audio signal;

means for detecting one or more errors in the frame and discarding the frequency-domain data as a result of detecting the errors;

means for estimating magnitudes of replacement frequency-domain data for the frame based on frequency-domain data included in neighboring frames of the frame;

means for estimating signs of the replacement frequency-domain data for the frame based on a subset of signs for the frame transmitted from an encoder as side-information of a neighboring frame of the frame; and means for combining the magnitude estimates and the sign estimates to estimate the replacement frequency-domain data for the frame.

* * * * *